US007470018B2

(12) United States Patent
Miyazaki et al.

(10) Patent No.: US 7,470,018 B2
(45) Date of Patent: Dec. 30, 2008

(54) RECORDING APPARATUS

(75) Inventors: Kenichi Miyazaki, Nagano (JP); Kazuyuki Fujioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 416 days.

(21) Appl. No.: 11/007,158

(22) Filed: Dec. 9, 2004

(65) Prior Publication Data

US 2005/0206959 A1 Sep. 22, 2005

(30) Foreign Application Priority Data

Dec. 9, 2003 (JP) ..... P2003-411038
Dec. 9, 2003 (JP) ..... P2003-411044
Dec. 9, 2003 (JP) ..... P2003-411050
Dec. 6, 2004 (JP) ..... P2004-353311

(51) Int. Cl.
*B41J 2/01* (2006.01)

(52) U.S. Cl. ..... 347/104; 347/101

(58) Field of Classification Search ..... 347/104, 347/8, 101, 16
See application file for complete search history.

(56) References Cited

U.S. PATENT DOCUMENTS 5,469,196 A * 11/1995 Okazaki et al. ..... 347/8
5,594,486 A * 1/1997 Kiyohara ..... 347/104
5,673,074 A * 9/1997 Miyauchi et al. ..... 347/104
5,685,538 A 11/1997 Schlageter
5,700,099 A * 12/1997 Kobayashi et al. ..... 400/625
5,730,537 A * 3/1998 Kelly et al. ..... 400/625
5,742,316 A * 4/1998 Hirano et al. ..... 347/104
5,764,372 A * 6/1998 Kondo ..... 358/414
5,818,487 A * 10/1998 Yoshimura et al. ..... 347/104
5,993,094 A * 11/1999 Lee ..... 400/625
6,116,590 A * 9/2000 Yokoyama et al. ..... 271/171
6,340,215 B1 * 1/2002 Yamakita ..... 347/4
6,877,854 B2 * 4/2005 Nishikawa ..... 347/104
2001/0017635 A1 * 8/2001 Kan et al. ..... 347/22
2002/0051668 A1 5/2002 Takeshi et al.

FOREIGN PATENT DOCUMENTS

JP 11-124271 A 5/1999
JP 11-320998 A 11/1999
JP 2000-198604 A 7/2000
JP 2002-67428 A 3/2002

* cited by examiner

*Primary Examiner*—Stephen D Meier
*Assistant Examiner*—Leonard S Liang
(74) *Attorney, Agent, or Firm*—Sughrue Mion, PLLC

(57) ABSTRACT

A recording section is configured to perform a recording operation with respect to a recording medium. An ejector is configured to eject the recording medium transported from the recording section to the outside of the recording apparatus. The ejector is provided with a plurality of press members. A switcher selectively causes none or one of the press members to abut against the recording medium.

8 Claims, 33 Drawing Sheets

FIG. 26

| CONDITION | SHEET TYPE | SHEET STATE | FOLLOWER ROLLER | SUPPORT RIB |
|---|---|---|---|---|
| 1 | CUT SHEET | NORMAL | SPUR ROLLER | PRESENT |
| 2 | CUT SHEET | DELICATE | LOG ROLLER | PRESENT |
| 3 | ROLLED SHEET | NORMAL | RELEASED | ABSENT |
| 4 | ROLLED SHEET | THIN | SPUR ROLLER (EJECTION ONLY) | ABSENT |
| 5 | ROLLED SHEET | HYGROSCOPIC | SPUR ROLLER (PRINTING AND EJECTION) | ABSENT |
| 6 | ROLLED SHEET | CUT SHORTLY | SPUR ROLLER ( EJECTION ONLY) | ABSENT |
| 7 | HAND-FED SHEET | THICK | RELEASED | ABSENT |

RECORDING APPARATUS

BACKGROUND OF THE INVENTION

The present invention relates to a recording apparatus that performs a recording operation by supplying a recording medium to a recording section and ejects the recording medium from an ejecting section, as well as to a like liquid ejection apparatus.

Among large-size recording apparatus capable of recording on up to a sheet (recording medium) of a relatively large size such as the A4 to A2 size of the JIS standard are ink jet printers. In such large-size ink jet printers, a sheet is supplied from and ejected to the front side for the following reason: unlike in small-size ink jet printers, it is difficult to supply a sheet from the back side and eject it to the front side because relatively heavy sheets need to be handled.

An ink jet printer is known in which a sheet supply tray and a sheet ejection tray are disposed on the front side. A sheet that is accommodated in the sheet supply tray is taken out by a sheet supply roller and then fed to a platen of a recording section by transporting the sheet by a sheet feeding roller and an associated follower roller while holding it between them. Recording is performed on the sheet by discharging ink droplets from a recording head, and the sheet is then ejected to the ejection tray by transporting it by a sheet ejection roller and a spur roller as an associated follower roller while holding it between them (cf., Japanese Patent Publication No. 11-124271A).

In the above ink jet printer, since the spur roller is used as the follower roller that is associated with the sheet ejection roller, scratches may be formed on the recording face of a sheet to lower the recording accuracy depending on the attribute of the sheet.

Further, where the above ink jet printer performs recording on a portion of a sheet close to its trailing edge, the trailing edge of the sheet may rise though the recording is going on because the trailing edge of the sheet is no longer held between the sheet feeding roller and an associated follower roller. This may result in a problem that recording unevenness occurs because the interval between the sheet and the recording head becomes non-uniform to vary the flying distance of ink droplets or the sheet touches the recording head and is thereby stained.

SUMMARY OF THE INVENTION

It is therefore an object of the present invention to provide a recording apparatus capable of maintaining highly accurate recording as well as a like liquid ejection apparatus.

In order to achieve the above object, according to the invention, there is provided a recording apparatus, comprising:

a recording section, configured to perform a recording operation with respect to a recording medium;

an ejector, configured to eject the recording medium transported from the recording section to the outside of the recording apparatus, the ejector comprising a plurality of press members; and a switcher, which selectively causes none or one of the press members to abut against the recording medium.

With this configuration, particularly in ejecting a sheet or paper whose recording face is prone to be scratched, the recording face can be prevented from being scratched by separating the press member, whereby the recording accuracy can be kept high.

Preferably, the state of the press members is selected in accordance with a property of the recording medium.

With this configuration, an optimum ejecting condition can be set in accordance with the property of the recording medium. In a case where it is configured an automatic switching operation can be performed, the scratching on the recording face due to the wrong switching operation of the user can be reliably avoided.

Preferably, the recoding section comprises: a guide face which supports the recording medium being transported; and a support member retractably projected from the guide face; and the switcher selectably causes the support member to be projected or retracted from the guide face.

With this configuration, projecting the supporting member particularly when a trailing end of the recording medium becomes a free end, the trailing end is supported so as to prevent from being lifted up. Accordingly, it is possible to execute a recording operation with high accuracy and the termination of the recording member can be avoided.

Here, it is preferable that the states of the press members and the support member are interlockingly selected in accordance a property of the recording medium.

Preferably, the ejector comprises a revolver in which the press members are arranged in a circumferential direction thereof. The switcher revolves the revolver such that one of the press members or a space between the press members is selectively opposed to the recording medium.

With this configuration, the mechanism of the switcher can be made simple so that the switching operation can be reliably executed.

According to the invention, there is also provided a liquid ejection apparatus, comprising:

a liquid ejecting section, configured to eject a liquid droplet toward a target medium;

an ejector, configured to eject the target medium transported from the liquid ejecting section to the outside of the liquid ejection apparatus, the ejector comprising a plurality of press members; and a switcher, which selectively causes none or one of the press members to abut against the target medium.

Preferably, the state of the press members is selected in accordance with a property of the target medium.

Preferably, the liquid ejecting section comprises: a guide face which supports the target medium being transported; and a support member retractably projected from the guide face. The switcher selectably causes the support member to be projected or retracted from the guide face.

Here, it is preferable that the states of the press members and the support member are interlockingly selected in accordance a property of the target medium.

Preferably, the ejector comprises a revolver in which the press members are arranged in a circumferential direction thereof. The switcher revolves the revolver such that one of the press members or a space between the press members is selectively opposed to the target medium.

With the above configurations, it is possible to provide a liquid ejection apparatus having the respective advantages described the above.

BRIEF DESCRIPTION OF THE DRAWINGS

FIG. 26 is a table showing conditions of the state switching of the follower roller unit and the supporting rib unit;

DETAILED DESCRIPTION OF THE INVENTION

An embodiment of the present invention will be hereinafter described in detail with reference to the accompanying drawings.

Figure 1:
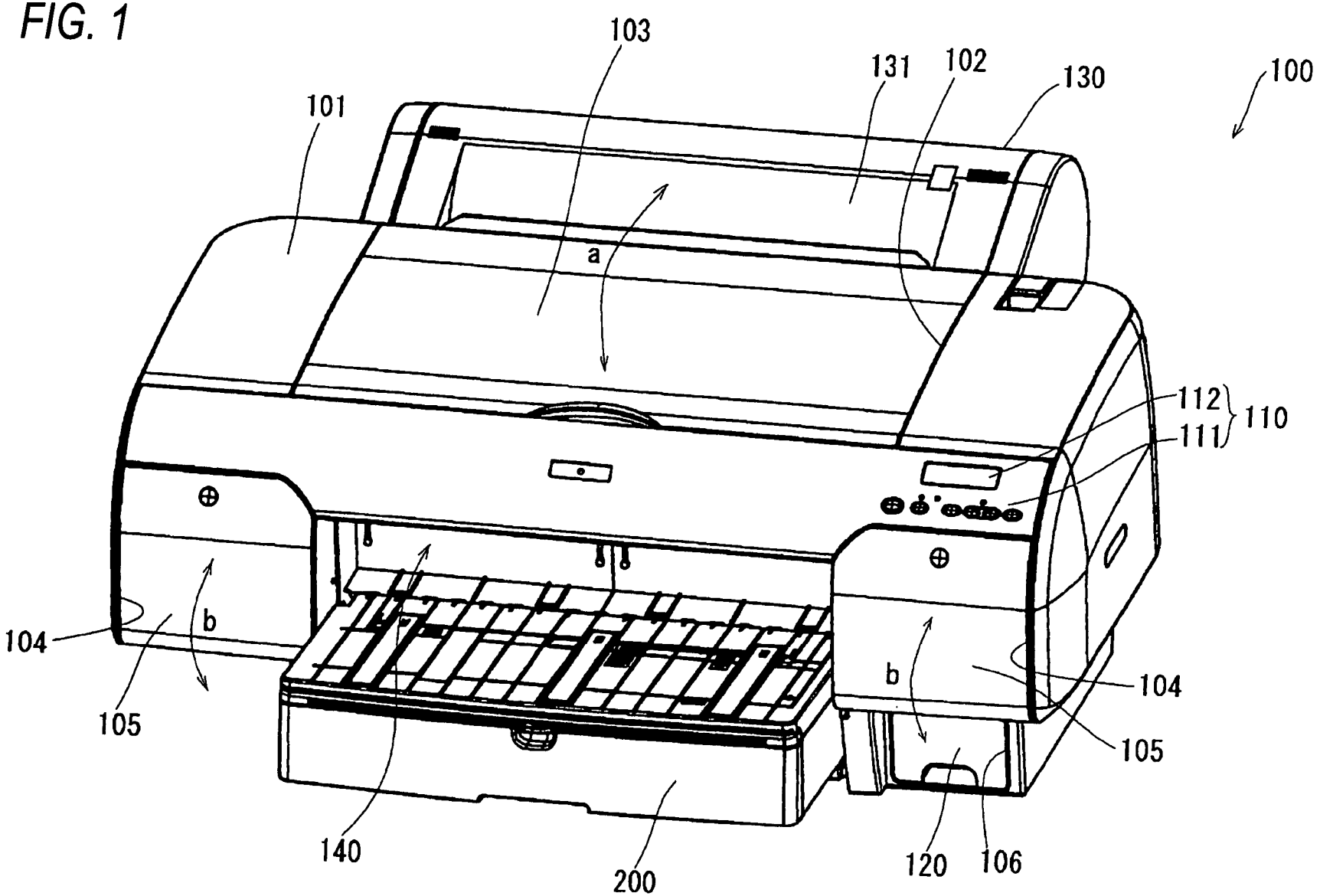
FIG. 1 is a perspective view of an ink jet printer according to one embodiment of the invention.

As shown in FIG. 1, an ink jet printer (recording apparatus) 100 according to an embodiment of the invention is a large-size, desk-top printer capable of recording on what is called cut sheets of a relatively large size such as the A4 to A2 size of the JIS standard and an equivalent roll of paper. The inside of the ink jet printer 100 is entirely covered with an housing 101 that generally assumes a rectangular parallelepiped shape that is long in the width direction.

The top face of the housing 101 is formed with a rectangular window 102, which is covered with a transparent or semi-transparent window cover 103. The window cover 103 is attached so as to be rotatable in directions indicated by arrow a in FIG. 1 about a rotation axis that is located on the rear side. A user can perform maintenance work or the like on the internal mechanisms through the window 102 by lifting up the window cover 103 and thereby opening the window 102.

Cartridge chambers 104 into and from which plural ink cartridges are to be inserted and removed are formed at the front-right and front-left positions of the housing 101. Recording inks of several colors are stored in the respective ink cartridges. The cartridge chambers 104 are covered with transparent or semi-transparent cartridge covers 105, respectively. Each cartridge cover 105 is attached so as to be rotatable in directions indicated by arrow b in FIG. 1 about a rotation axis that is located at the bottom. The user can perform ink cartridge replacement work or the like by opening a cartridge chamber 104 by weakly pushing the cartridge cover 105 and thereby unlocking a locking portion.

A control panel 110 by which to input an instruction of a printer operation is provided in a portion of the housing 101 that is located over the front-right cartridge chamber 104. The control panel 110 is provided with buttons 111 such as a power button for turning on or off the power, buttons for operations for paper leading end positioning, ink flashing, etc., and buttons for image processing etc., a liquid crystal panel 112 for displaying various statuses, and other members. The user can manipulate the buttons 111 while watching the liquid crystal panel 112 to check displayed information.

A tank chamber 106 into and from which a waste liquid tank 120 is to be inserted and removed is formed under the front-right cartridge chamber 104. The waste liquid tank 120 stores waste ink that is discarded at the time of cleaning of a recording head 162 (see FIG. 5) or replacement of an ink cartridge. The user can perform, for example, work of discarding the waste ink stored in the waste ink tank 120 by drawing out the waste ink tank 120.

A paper supplying section 130 for supplying a part of rolled paper is disposed at the rear of the housing 101 so as to project in a top-rear direction. A rolled paper holder (not shown) in which one roll of paper can be set is provided inside the paper supplying section 130, and a flap-type rolled paper cover 131 that can be opened and closed is attached to the paper supplying section 130 on the front side so as to cover the rolled paper holder. The user can perform, for example, work of attaching or removing a roll of paper by lifting up the rolled paper cover 131 and thereby opening the paper supplying section 130. The top face of the rolled paper cover 131 is formed into a sheet supply guide face capable of guiding cut sheets for manual feeding.

A sheet supplying/ejecting section 140 into and from which a tray unit 200 to be loaded with unrecorded cut sheets and recorded cut sheets or recorded parts of rolled paper is to be inserted and removed is formed in the housing 101 at the front-center, that is, between the two cartridge chambers 104. The sheet supplying/ejecting section 140 is formed so as to also allow manual feeding of thick sheets that cannot be bent while being transported.

The tray unit 200 is fixed to the sheet supplying/ejecting section 140 in such a manner that the front portion of the tray unit 200 is inserted in the sheet supplying/ejecting section 140 and the rear portion is projected therefrom. The tray unit 200 assumes a cassette-like shape; unrecorded cut sheets are stacked and accommodated inside and recorded and ejected cut sheets or parts of rolled paper are stacked thereon. A detailed structure of the tray unit 200 will be described below with reference to FIGS. 2-4.

Figure 2:
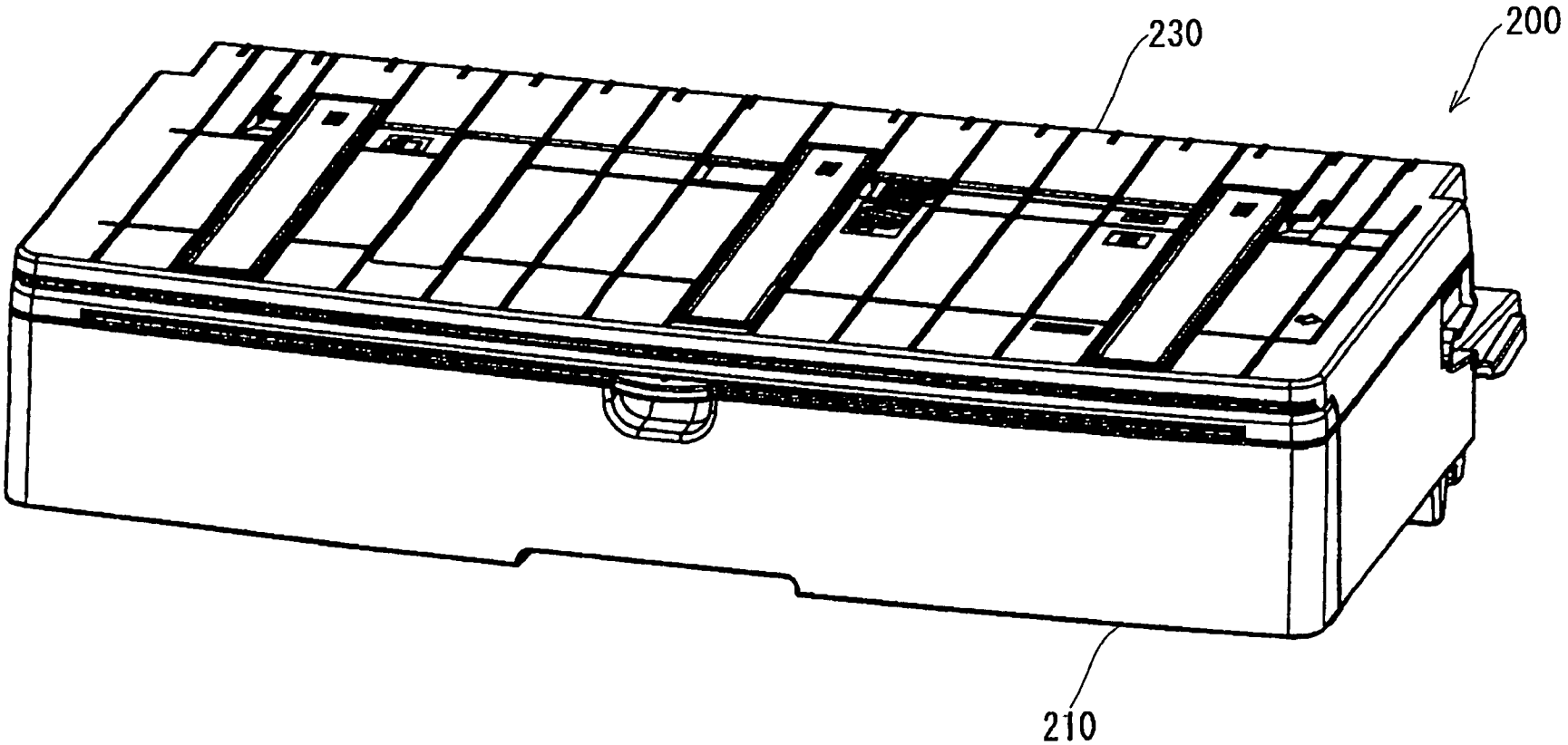
FIG. 2 is a perspective view of a tray unit in the printer of FIG. 1.

As shown in FIG. 2, the tray unit 200 has a box-shaped sheet supply tray 210 and a lid-shaped sheet ejection tray 230 that covers the sheet supply tray 210 from above. Capable of expansion and contraction in the sheet supplying/ejecting direction, the tray unit 200 can be accommodated compactly while not in use and can accommodate cut sheets of various sizes while in use.

Figure 3:
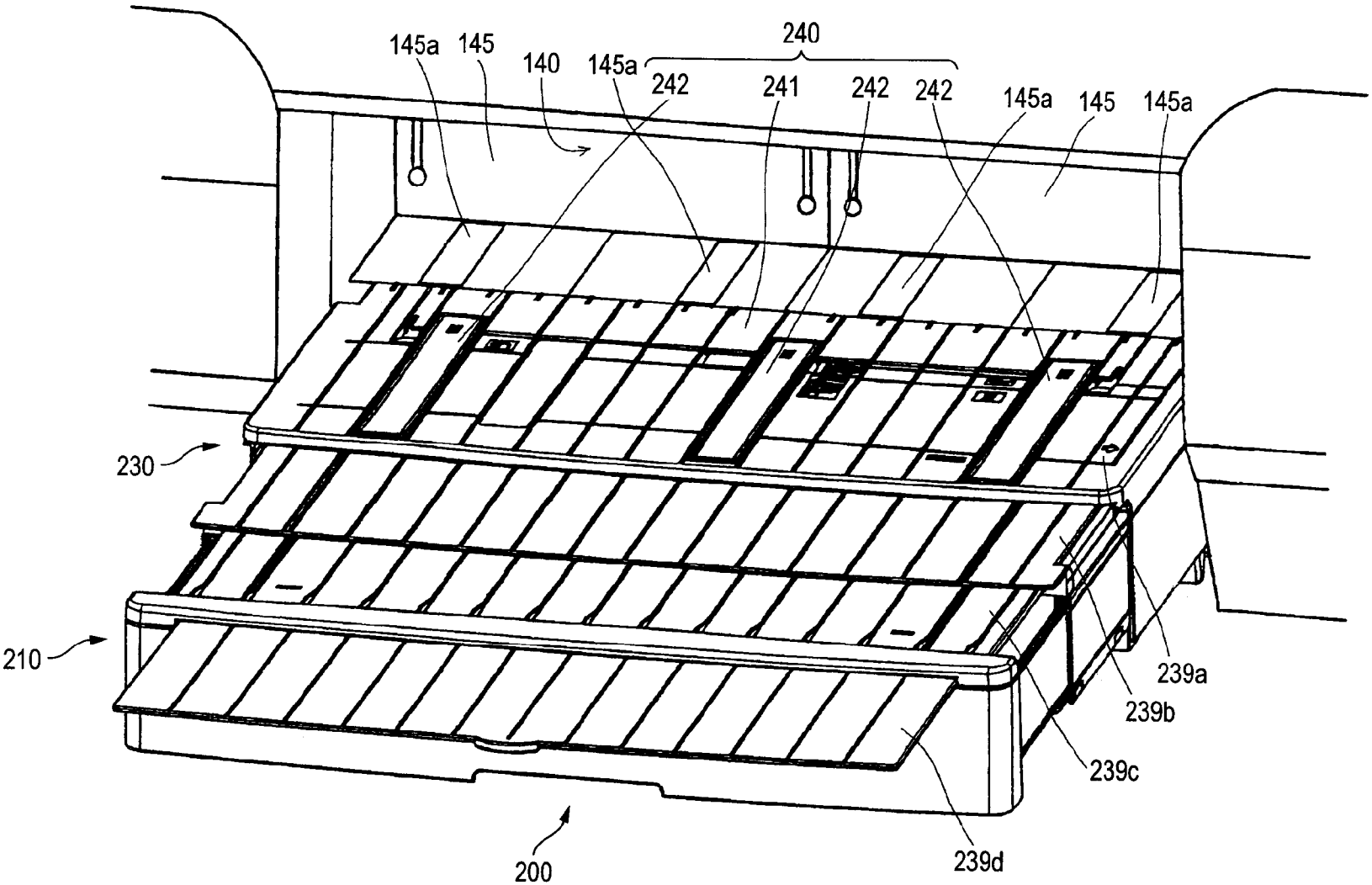
FIG. 3 is a perspective view showing a used state of the tray unit of FIG. 2.

To be mounted with cut sheets in a stacked manner, as shown in FIG. 3, a rolled paper guiding section 240 is made flush with the top face of a sheet ejection member 239*a* to form a flat plane together with the top face of the sheet ejection member 239*a*. With this measure, cut sheets that are ejected after passing by a sheet ejection roller 155 (see FIG. 5) are stacked smoothly on an ejected sheet receiving face that is formed by the rear and bottom faces of a guide portion 145 having an L-shaped cross section and the top faces of sheet ejection members 239*a*-239*d*.

Sponge mats 145*a* are pasted on the bottom face of the guide portion 145. The sponge mats 145*a* have a slip-preventing function of preventing a phenomenon that when a second cut sheet comes in a state that a first cut sheet is already mounted, the head of the second cut sheet pushes the first cut sheet and makes it fall from the ejected sheet receiving face.

Figure 4:
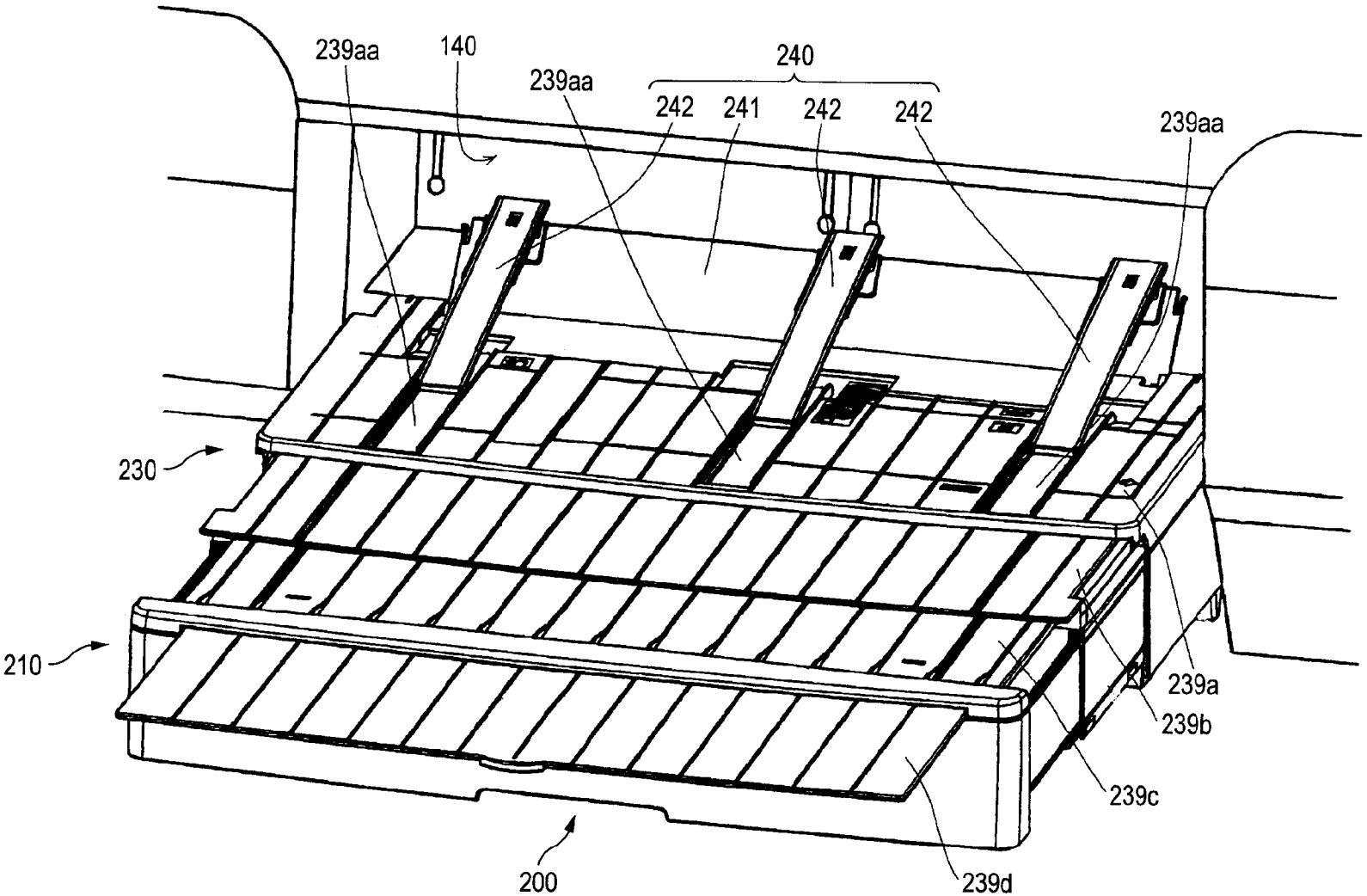
FIG. 4 is a perspective view showing another used state of the tray unit of FIG. 2.

On the other hand, to stack cut parts of rolled paper, as shown in FIG. 4, the user hooks his finger on a first guide plate 241 of the rolled paper guiding section 240 that is in the same plane as the top face of the sheet ejection member 239*a* and turns it rearward. As a result, second guide plates 242 are pulled by the first guide plate 241, whereby their one ends in the longitudinal direction are lifted up and the other ends in the longitudinal direction slide rearward along respective grooves 239*aa* that are formed in the top face of the sheet ejection member 239*a*. The user turns the first guide plate 241 until the first guide plate 241 and the second guide plates 242 form an acute angle.

As a result, the one ends in the longitudinal direction of the second guide plates 242 come close to the top of the rear face of the guide portion 145 and the second guide plates 242 come to assume slide-like shapes. By virtue of this structure, even if a cut part of rolled paper that is ejected after passing by the sheet ejection roller 155 is curled, its tip portion does not go toward the guide portion 145 but slides on the slide-shaped second guide plates 242 and is guided onto the top faces of the sheet ejection members 239*a*-239*d*. In this manner, cut parts of rolled paper are smoothly stacked on an ejected sheet receiving face that is formed by the top faces of the second guide plates 242 and the sheet ejection members 239*a*-239*d*.

Figure 5:
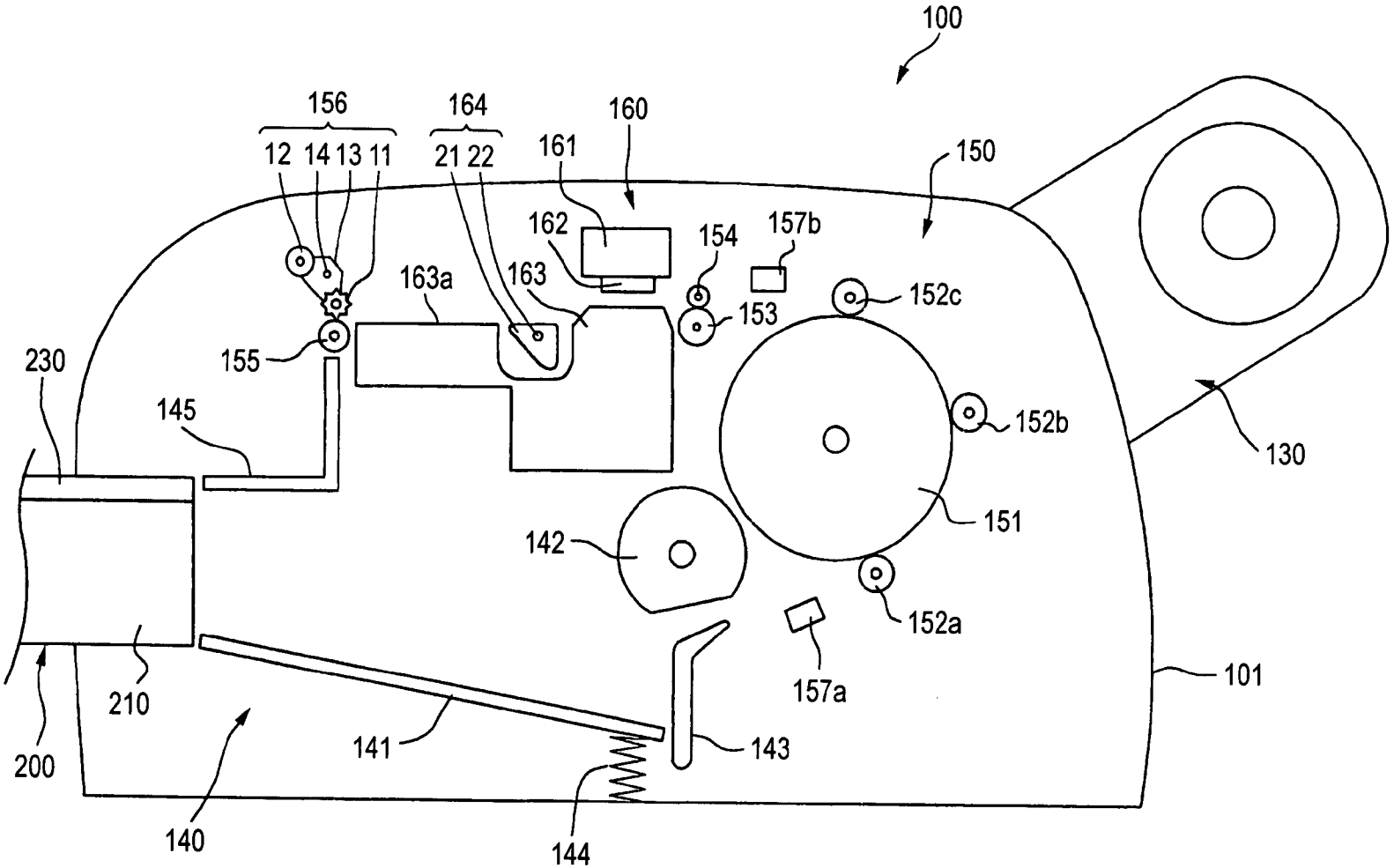
FIG. 5 is a schematic section view showing an internal configuration of the printer of FIG. 1.

As shown in FIG. 5, the sheet supplying/ejecting section 140, a transporting section 150 and a recording section 160 that include important features of the invention, and other components are provided in the housing 101. The sheet supplying/ejecting section 140 is equipped with a hopper 141 for supplying cut sheets, a sheet supply roller 142, a separation member 143, etc. The hopper 141 assumes a flat plate shape capable of being mounted with cut sheets, and is disposed in such a manner that one end is close to the sheet supply roller 142 and the separation member 143 and the other end is close to the bottom face of the sheet supply tray 210 of the inserted tray unit 200. One end of a compression spring 144 is attached to the bottom face of the housing 101 and the other end is attached to the back face of the hopper 141 at its one end. The hopper 141 is rotated about the other end as the compression spring 144 expands or contracts.

The sheet supply roller 142, which has a D-shaped cross section having a cut, friction-transports cut sheets from the hopper 141 by rotating intermittently. The separation member 143, which has a rough top face, friction-separates lower cut sheets from the uppermost one when plural cut sheets are supplied by the sheet supply roller 142. A relationship between the cut sheets mounted on the hopper 141 and the sheet supply roller 142 will now be described with reference to FIGS. 6A and 6B.

Figure 6A:
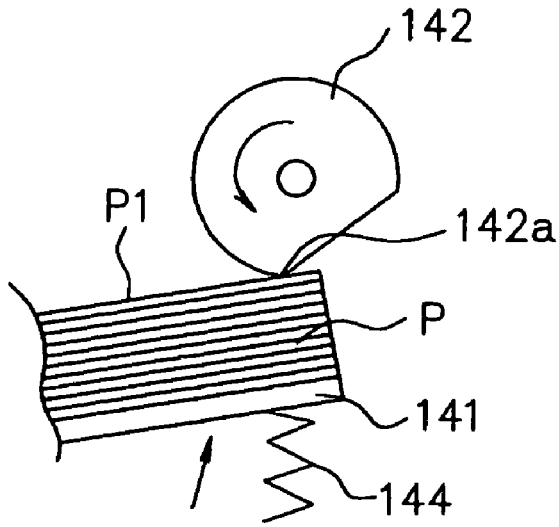
FIGS. 6A and 6B are schematic views showing a contact state of a sheet on a hopper and a sheet feeding roller in the printer of FIG. 1.

FIG. 6A shows a case that a maximum number of cut sheets P are mounted on the hopper 141. Settings are made so that in this case when the hopper 141 is elevated the uppermost cut sheet P1 does not touch the cut portion of the sheet supply roller 142 but touches an arc start point 142*a* or a point on the circumference that is slightly distant from the arc start point 142*a*.

Figure 6B:
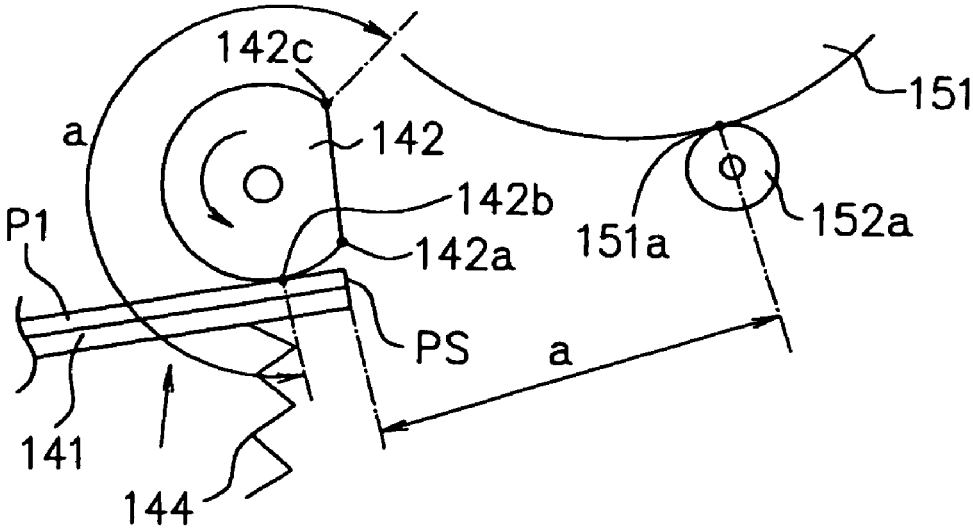

FIG. 6B shows a case that a minimum number (one) of cut sheet P1 is mounted on the hopper 141. The setting are made so that in this case when the hopper 141 is elevated the cut sheet P1 touches a point 142*b* of the sheet supply roller 142 that is a little distant from the arc start point 142*a*. The contact point 142*b* is such a point that the circumferential length between the contact point 142*b* and an arc end point 142*c* is the same as the interval a between the tip PS of the sheet P1 and a contact point 151*a* of a sub roller 151 and an associated follower roller 152*a*.

With the above settings, if the number of cut sheets P mounted on the hopper 141 is smaller than or equal to the maximum number, the uppermost cut sheet P1 is not released from the sheet supply roller 142 until the tip PS of the cut sheet P1 reaches the contact point 151*a* of the sub roller 151 and an associated follower roller 152*a*. Therefore, the cut sheet P1 can be delivered reliably to the sub roller 151 and erroneous sheet delivery can be avoided.

The transporting section 150 is equipped with the sub roller 151 and an associated follower rollers 152*a*, 152*b*, and 152*c* for transporting a sheet, a sheet feeding roller 153 and an associated follower roller 154, a sheet ejection roller 155 and an associated follower roller unit 156 that constitute an ejecting section, sensors 157*a* and 157*b* for detecting a sheet, and other components. To eject, to the sheet ejection tray 230, a cut sheet that is supplied from the sheet supply tray 210, the sub roller 151 transports the cut sheet along a U-shaped path (the transport direction is reversed) while holding it together with the follower rollers 152*a*, 152*b*, and 152*c*. To eject, to the sheet ejection tray 230, a part of rolled paper that is supplied from the paper supplying section 130, the sub roller 151 transports it while holding it together with the follower roller 152*c*.

The sheet feeding roller 153 sends out, to a platen 163, a cut sheet that has been transported with reversal in direction or a supplied part of rolled paper while holding it together with the follower roller 154. The sheet ejection roller 155 ejects, onto the sheet ejection tray 230, a sheet or paper that has passed by the platen 163 while supporting it solely or together with the follower roller unit 156. The sensor 157*a* detects a transport length of a supplied cut sheet at the time of skew taking. The sensor 157*b* detects a transport length of a cut sheet that has been transported with reversal in direction or a supplied part of rolled paper at the time of paper leading end positioning operation.

The follower roller unit 156 is equipped with sets of a spur roller 11 and a smooth roller 12 that are brought in contact with or separated from the recording face of a sheet or paper being transported on the sheet ejection roller 155 and a switching shaft 14 for switching the rollers 11 and 12 between contact and separation. Having saw-toothed projections on the circumferential face, the spur roller 11 serves to transport a sheet or paper reliably by cutting into its recording face while holding it together with the sheet ejection roller 155.

Having a smooth circumferential face, the smooth roller 12 serves to transport a sheet or paper reliably by pressing on its recording face while holding it together with the sheet ejection roller 155. The spur roller 11, the smooth roller 12, and a release portion 13 where neither the spur roller 11 nor the smooth roller 12 is provided are disposed around the switching shaft 14 at prescribed intervals in the circumferential direction, and plural sets of the rollers 11 and 12 and the release portion 13 are arranged in the axial direction at prescribed intervals.

The above-configured follower roller unit 156 can arbitrarily switch between the spur rollers 11 and the smooth rollers 12, between the spur rollers 11 and the release portions 13, and between the smooth rollers 12 and the release portions 13 by rotating the switching shaft 14. The switching between the spur rollers 11 and the release portions 13 or between the smooth rollers 12 and the release portions 13 is equivalent to bringing the spur rollers 11 or smooth rollers 12 into contact with or separating those from the recording face of a sheet or paper. Therefore, this switching makes it possible to adapt to many kinds of sheets and paper having respective attributes. Although the follower roller unit 156 is equipped with, in each set, the three kinds of single members, that is, the spur roller 11, the smooth roller 12, and the release portion 13, the invention is not limited to such a case. One or more kinds of members may be combined arbitrarily, the number of members of each kind being two or more.

Figure 13:
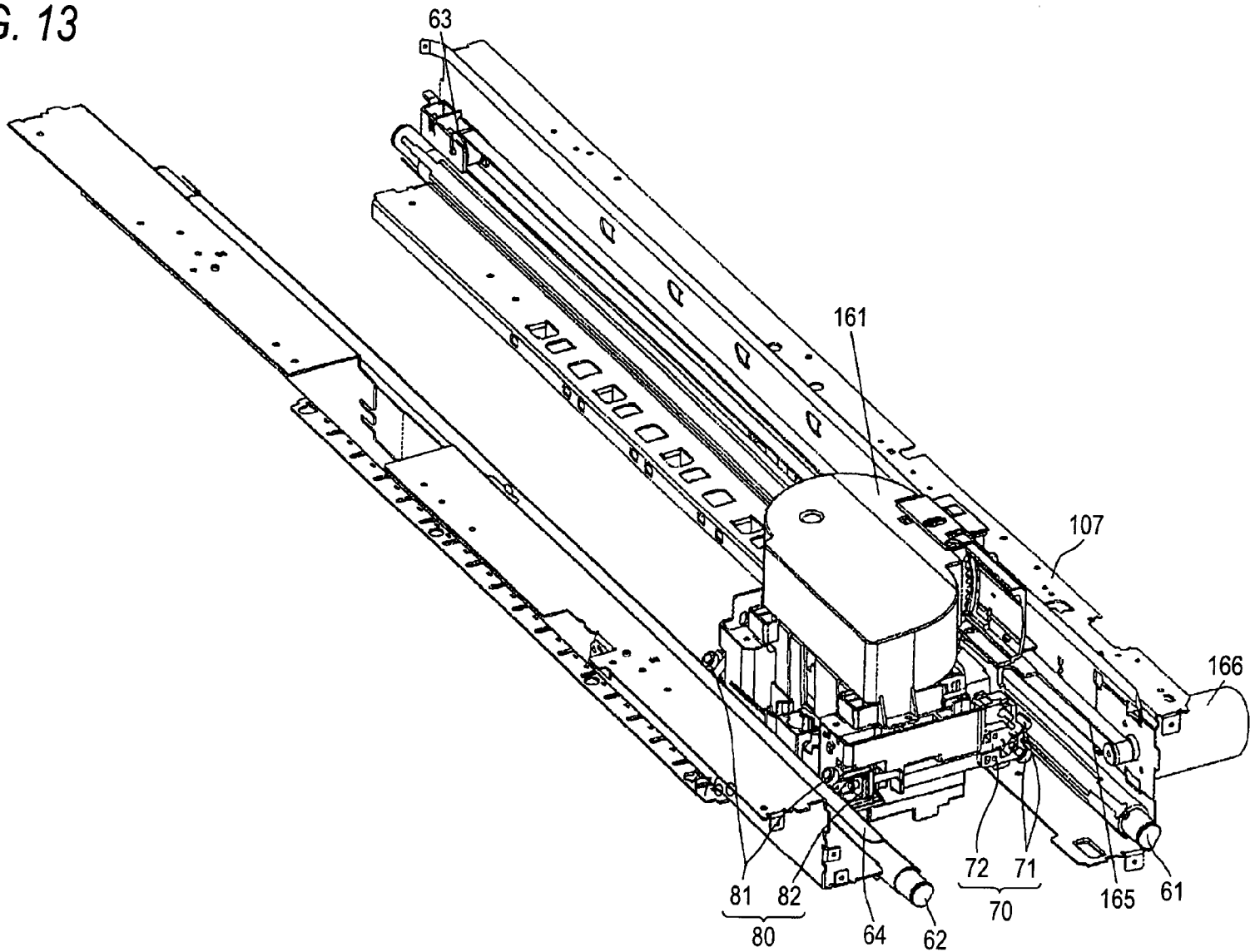
FIG. 13 is a perspective view of a periphery of a carriage in the printers shown in FIGS. 1 and 7.

The recording section 160 is equipped with a carriage 161, a recording head 162, the platen 163, a support rib unit 164, etc. As shown in FIG. 13, the carriage 161 is connected to a carriage belt 165. As the carriage belt 165 is driven by a carriage motor 166, the carriage 161 is moved together with the carriage belt 165 and is thereby reciprocated above a sheet or paper perpendicularly to the sheet transport direction being guided by a main guide shaft 61 and an auxiliary guide shaft 62. The carriage 161 is mounted with the recording head 162 capable of discharging ink droplets toward an underlying sheet or paper.

For example, the recording head 162 is equipped with plural black ink recording heads for discharging two kinds of black inks and plural color ink recording heads for discharging ink droplets of six colors of yellow, dark yellow, cyan, light cyan, magenta, and light magenta, respectively. The recording head 162 is provided with pressure generating chambers and nozzle orifices that communicate with the respective pressure generating chambers. Inks are stored in the pressure generating chambers and pressurized at a prescribed pressure, whereby ink droplets having a controlled size are discharged toward the sheet or paper on the platen 163. A guide face 163*a* as the top face of the platen 163 supports and guides, by itself or together with the support rib unit 164, a sheet or paper being transported from the sheet feeding roller 153 and the follower roller 154 to the sheet ejection roller 155 and the follower roller unit 156.

Figure 18:
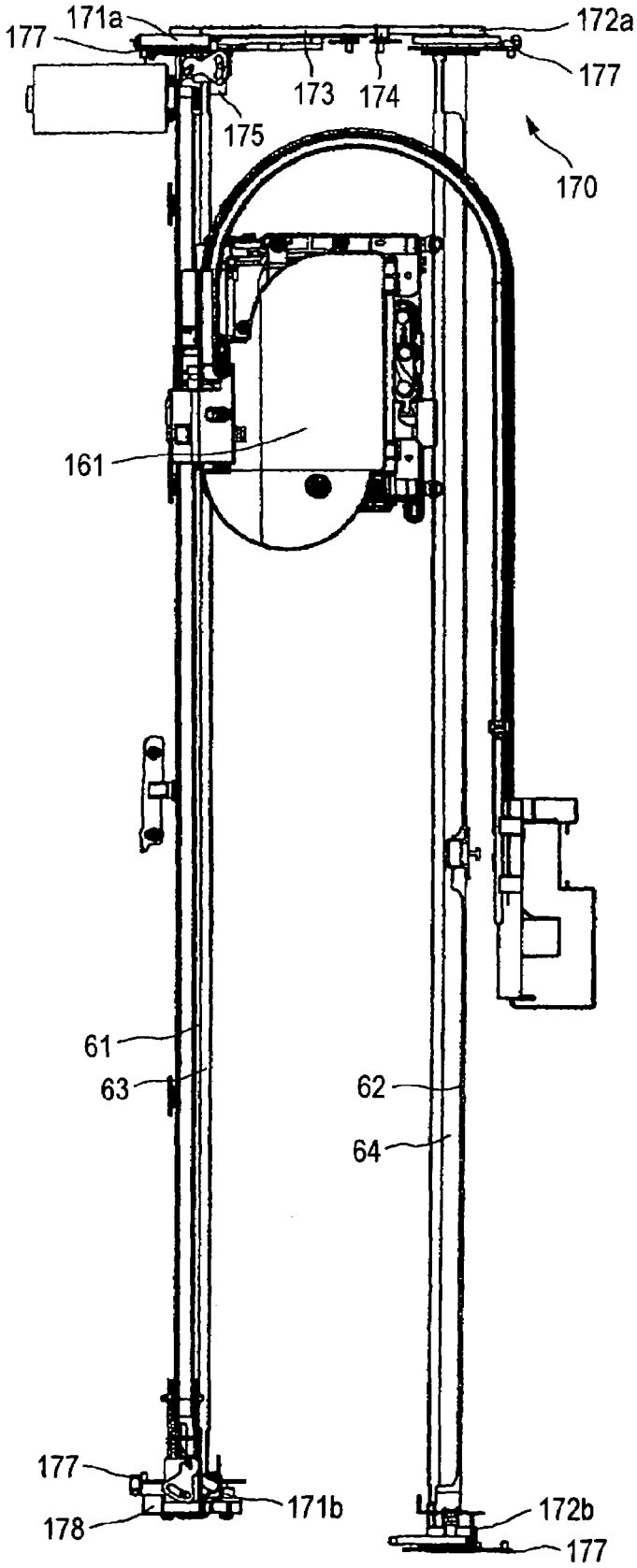
FIG. 18 is a plan view showing a platen gap adjusting mechanism and its periphery in the printers shown in FIGS. 1 and 7.

To enable recording on many kinds of sheets and paper having respective attributes (i.e., different thicknesses), a platen gap adjustment mechanism 170 for adjusting the gap between the nozzle formation face of the recording head 162 that is mounted on the carriage 161 and the recording face of a sheet or paper being transported on the guide face 163*a* of the platen 163 is provided (see FIG. 18). The main guide shaft 61 and the auxiliary guide shaft 62 are rotatable about respective eccentric rotation axes. The platen gap adjustment mechanism 170 adjusts the gap so that it is always kept constant by rotating the main guide shaft 61 and the auxiliary guide shaft 62 synchronously.

Figure 22:
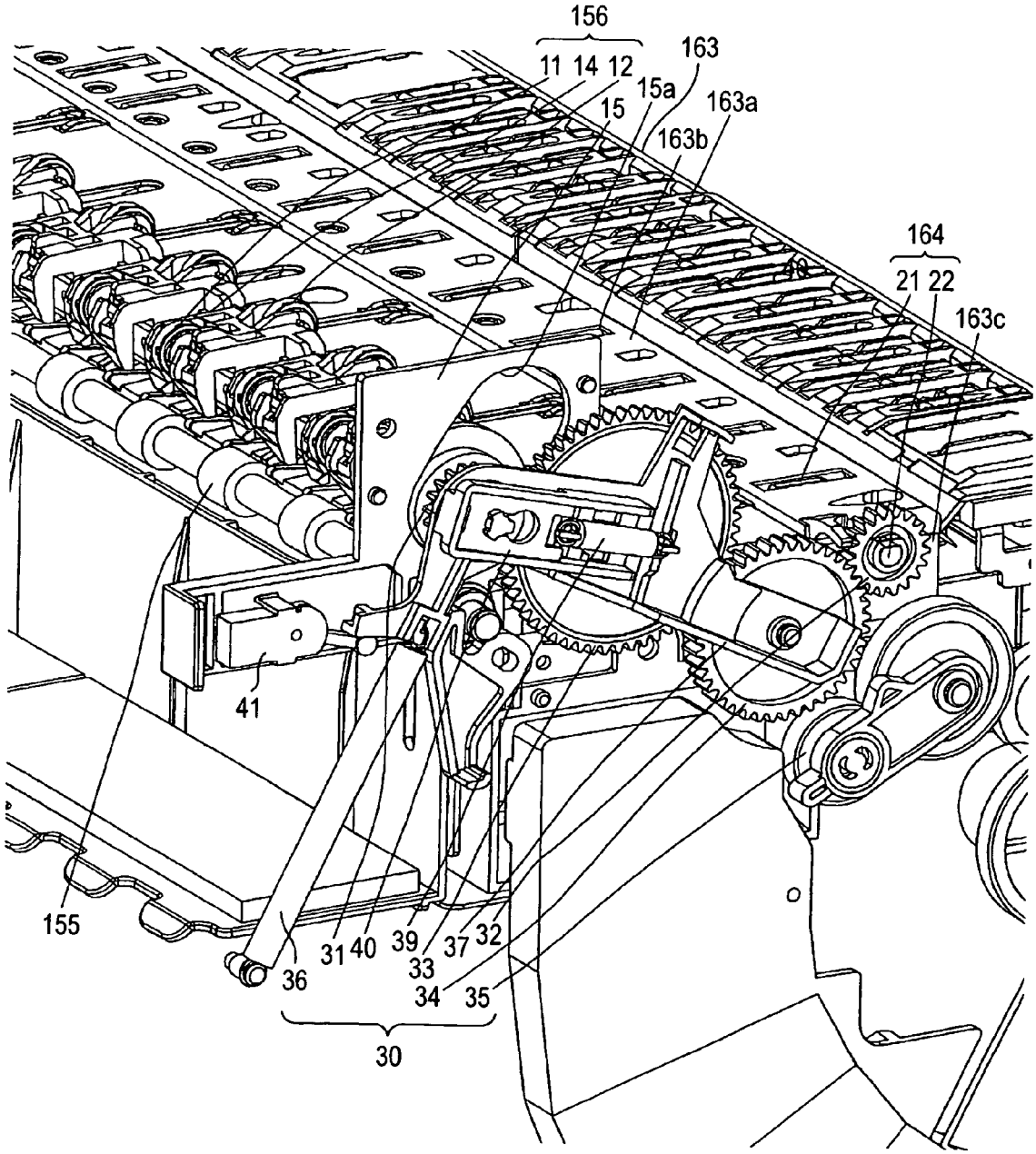
FIGS. 22 and 23 are perspective views showing details of a follower roller unit and a supporting rib unit in the printers shown in FIGS. 1 and 7.

As shown in FIG. 22, the support rib unit 164 is equipped with support ribs (projections) 21 that protrude or retract from slits 163*b* that are formed in the guide face 163*a* of the platen 163 and a switching shaft 22 for switching the support ribs 21 between protrusion and retraction. Each support rib 21 is generally shaped like a triangular plate, and one arc-shaped apex portion protrudes from the guide face 163*a* and supports a sheet or paper. The two ends of the switching shaft 22 are pivotally supported by side faces 163*c* of the platen 163. Plural support ribs 21 are fixed to the switching shaft 22 so as to be arranged in the axial direction at prescribed intervals.

The above-configured support rib unit 164 makes it possible to arbitrarily switch between the one arc-shaped apex portion and the flat portion of each support rib 21 in the slit 163*b* that is formed in the guide face 163*a* of the platen 163 by rotating the switching shaft 22. That is, the support rib 21 can be protruded by positioning the one arc-shaped apex portion of the support rib 21 with respect to the slit 163*b* that is formed in the guide face 163*a* of the platen 163, and the support rib 21 can be retracted by positioning the flat portion of the support rib 21 with respect to the slit 163*b*. Therefore, the above switching makes it possible to adapt to many kinds of sheets and paper having respective attributes (described later in detail).

Figure 7:
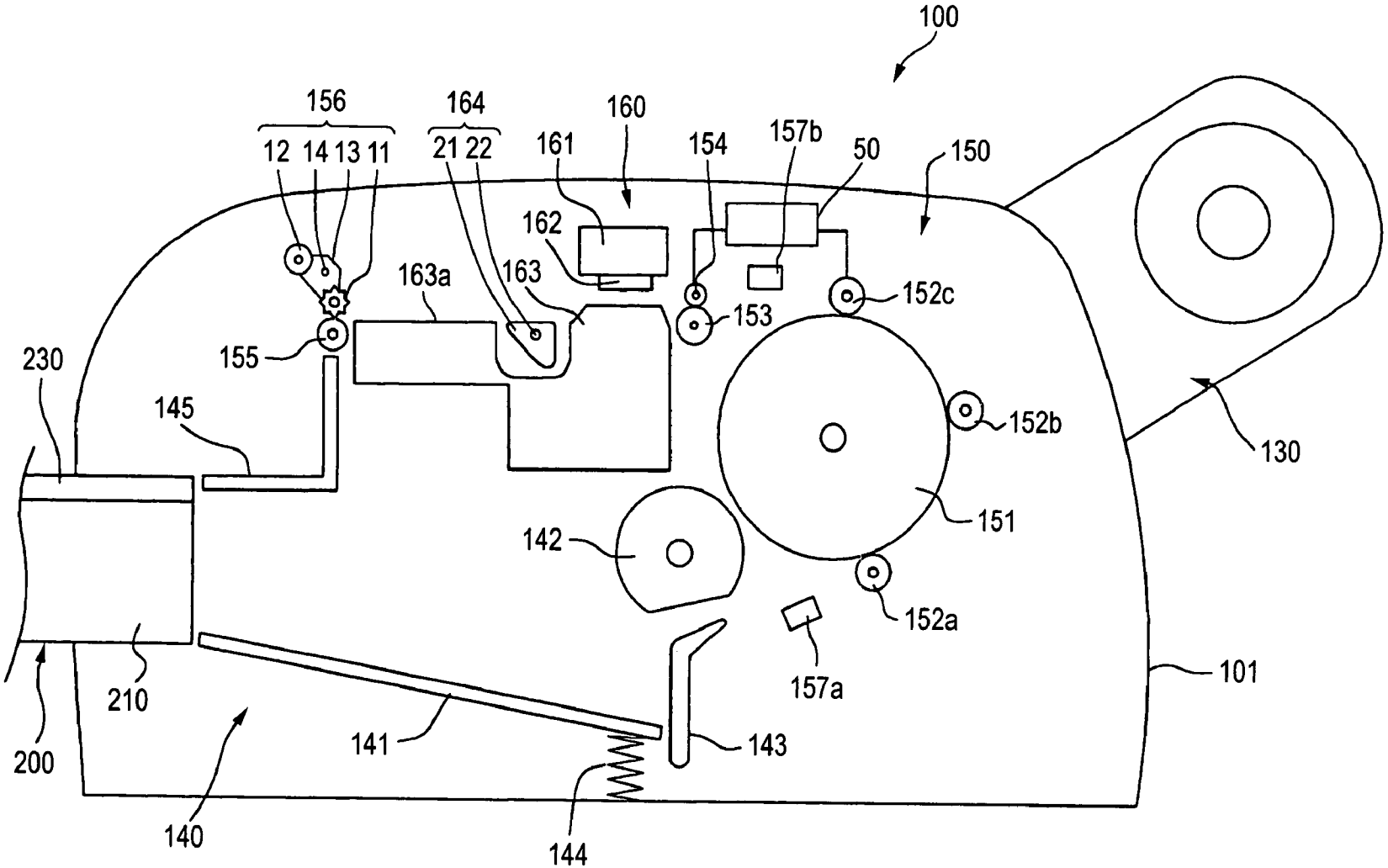
FIG. 7 is a schematic section view of a modified example of the internal configuration of the printer of FIG. 1.

As shown in FIG. 7, a follower roller driving device 50 for controlling the operation of bringing the follower rollers 152*a*, 152*b*, and 152*c* into contact with or separating those from the sub roller 151 and the operation of bringing the follower roller 154 into contact with or separating it from the sheet feeding roller 153 may be provided. This makes it possible to lower the power consumption of the ink jet printer 100 and to thereby reduce its size.

Figure 8:
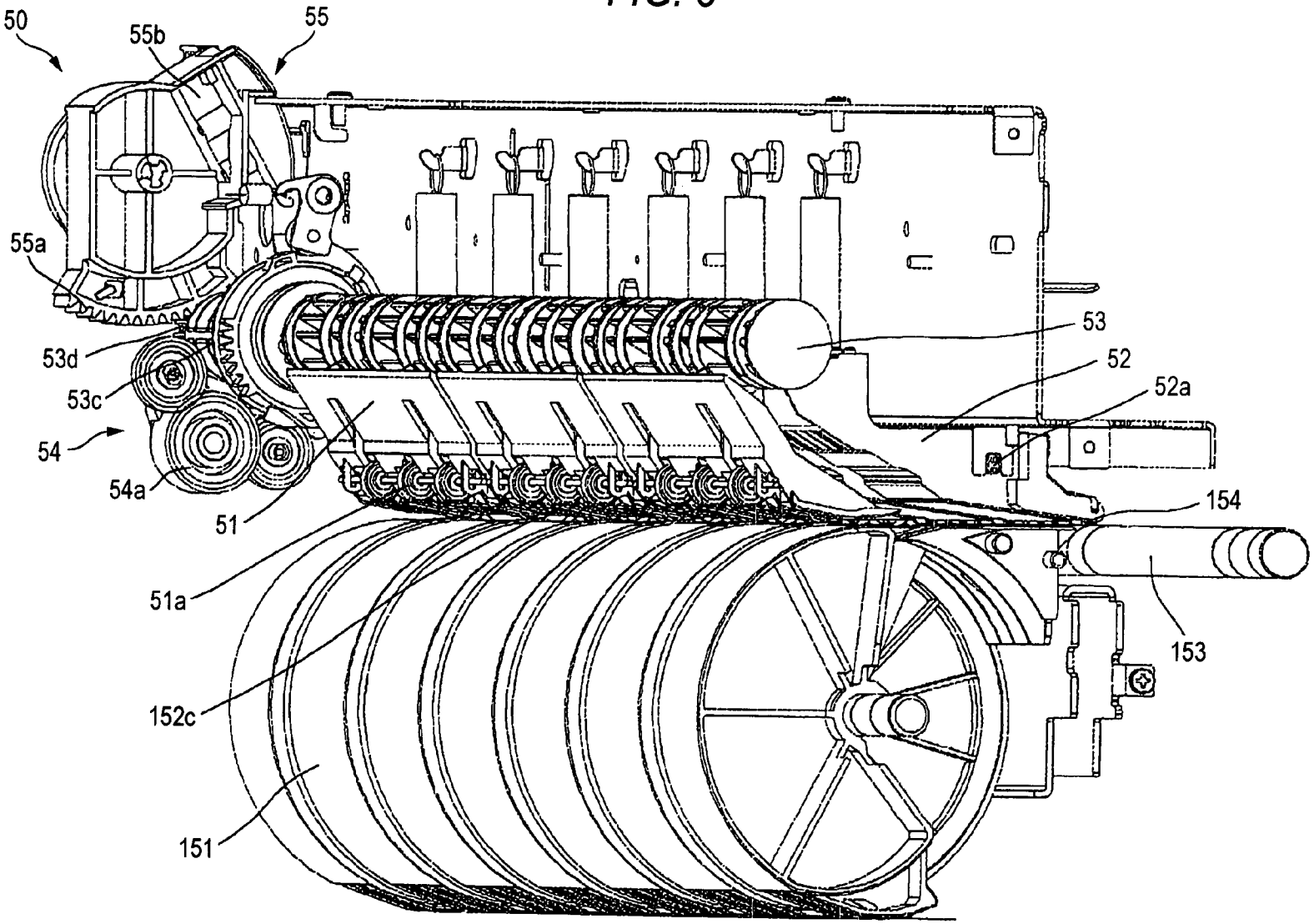
FIG. 8 is a perspective view showing a follower roller driving device and its periphery in the printer of FIG. 7.

As shown in FIG. 8, the follower roller driving device 50 is equipped with pivoting members 51 and 52, a cam shaft 53, and gear units 54 and 55. The follower roller 152*c* is rotatably attached to one end of the pivoting member 51 and the other end of the pivoting member 51 is to contact the cam shaft 53. And the pivoting member 51 is configured to pivot about a central shaft 51*a*. The follower roller 154 is rotatably attached to one end of the pivoting member 52 and the other end of the pivoting member 52 is to contact the cam shaft 53. And the pivoting member 52 is configured to pivot about a central shaft 52*a*.

The cam shaft 53 is separately provided with a cam 53*a* (see FIG. 9) that acts on the pivoting member 51 and a cam 53*b* (see FIG. 11) that acts on the pivoting member 52. An intermittent gear 53*c* to mesh with the gear unit 54 and an intermittent gear 53*d* to mesh with the gear unit 55 are fit in the cam shaft 53 at one end. The gear unit 54 is provided with a planetary gear 54*a* for intermittently transmitting drive force of a motor (not shown) to the intermittent gear 53*c* of the cam shaft 53. The gear unit 55 is provided with a lever 55*b* that is rotatable and can be operated manually and that is formed with a gear 55*a* to mesh with the intermittent gear 53*d* of the cam shaft 53. How the above-configured follower roller driving device 50 operates will be described below with reference to the drawings.

Figure 9:
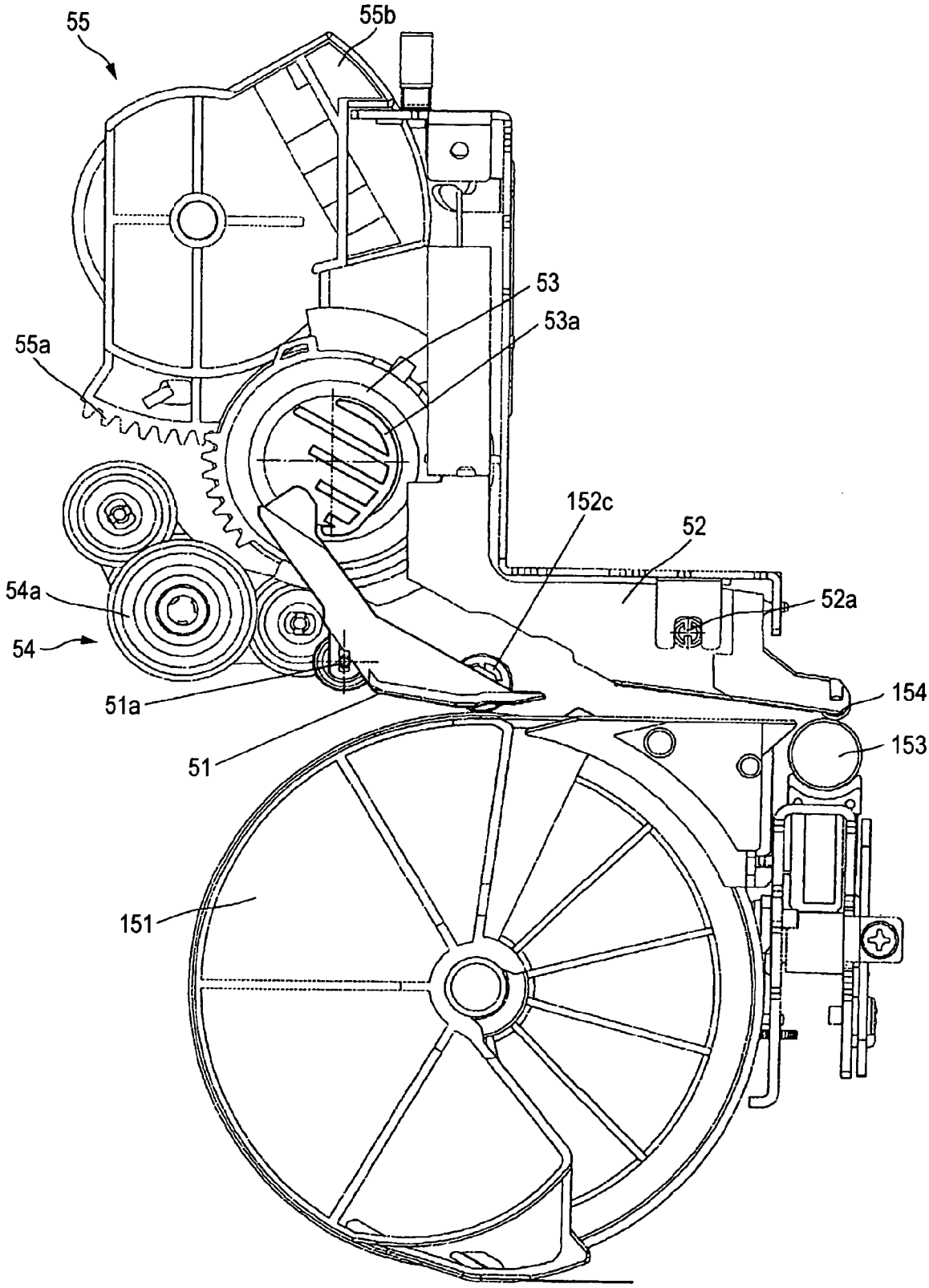
FIGS. 9 and 10 are section views showing a case where only a follower roller of a sub roller is operated in the printer of FIG. 7.
Figure 10:
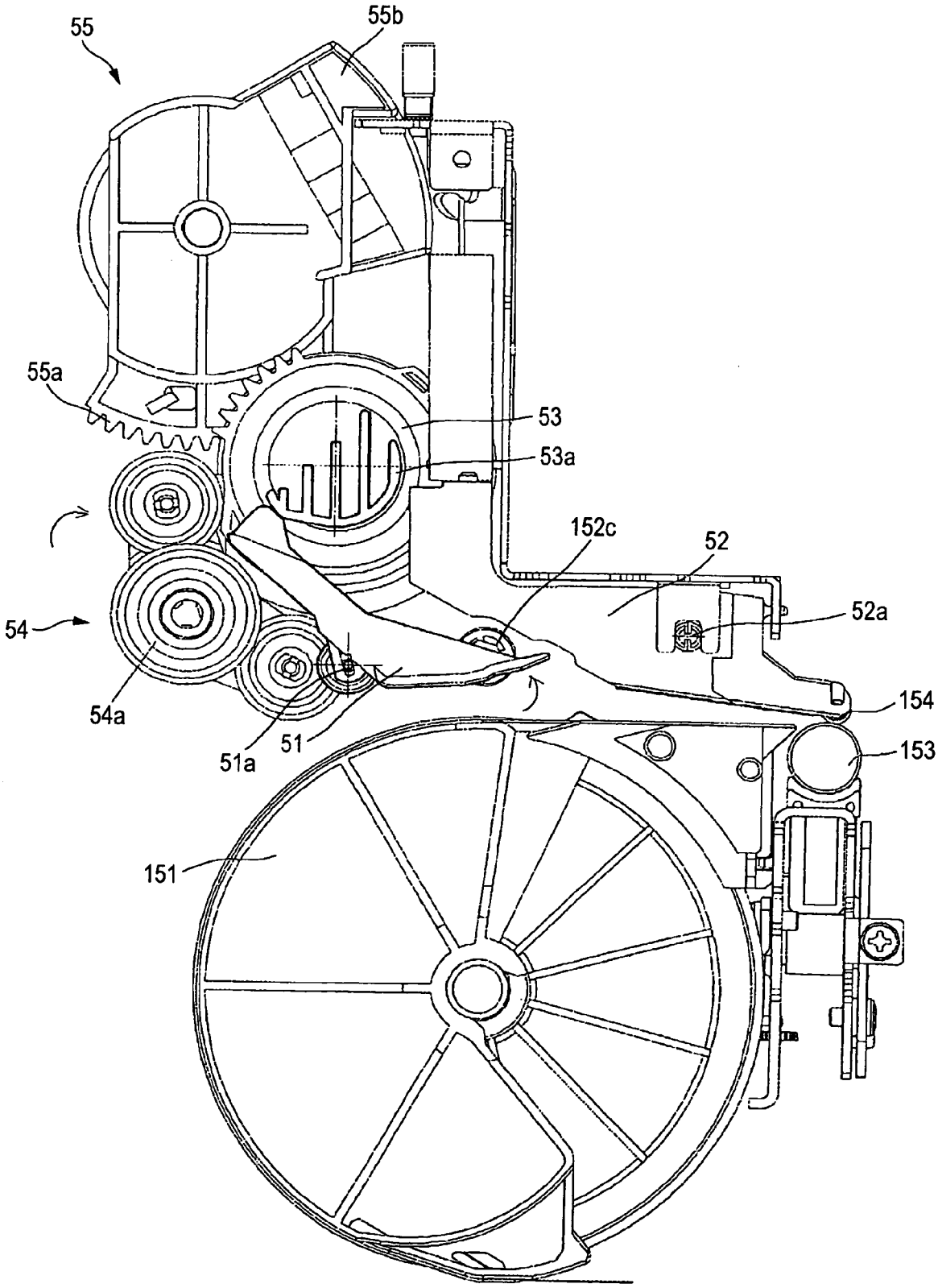

FIGS. 9 and 10 show a case that only the follower roller 152*c* is caused to operate. FIG. 9 shows a state that the follower roller 152*c* is in contact with the sub roller 151 and the follower roller 154 is in contact with the sheet feeding roller 153. In this state, the planetary gear 54*a* is separated from the intermittent gear 53*c* and the cam 53*a* is separated from the other end of the pivoting member 51. The lever 55*b* is located at a contact position, and the cam 53*b* is separated from the other end of the pivoting member 52 (not shown in FIG. 9).

FIG. 10 shows a state that the planetary gear 54*a* has been driven by the motor (not shown) and is thereby meshed with the intermittent gear 53*c*. As a result, the cam 53*a* pushes the other end of the pivoting member 51 and hence the follower roller 152*c* which is pivotally supported by the pivoting member 51 at the one end is separated from the sub roller 151.

When a sheet or paper is supplied, to reliably deliver it from the sub roller 151 to the sheet feeding roller 153, it is necessary that as shown in FIG. 9 the follower roller 152*c* be in contact with the sub roller 151 and the follower roller 154 be in contact with the sheet feeding roller 153. On the other hand, when recording is performed on a sheet or paper, it is necessary that as shown in FIG. 10 the follower roller 152*c* be separated from the sub roller 151 and the follower roller 154 be in contact with the sheet feeding roller 153, because contact of the follower roller 152*c* to the sub roller 151 would adversely affect the sheet feed accuracy.

Figure 11:
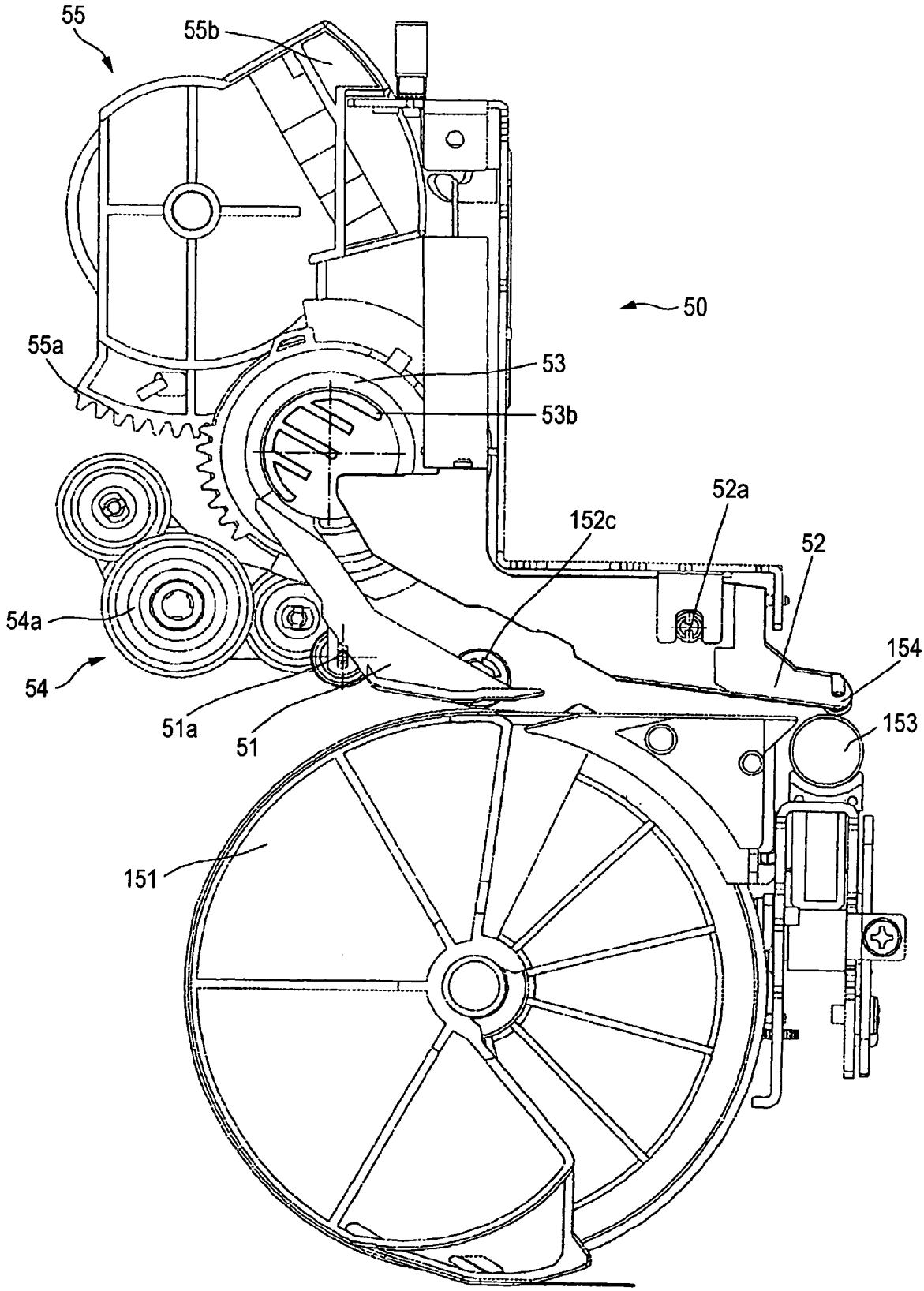
FIGS. 11 and 12 are section views showing a case where both of the follower roller of the sub roller and a follower roller of the sheet feeding roller are operated in the printer of FIG. 7.
Figure 12:
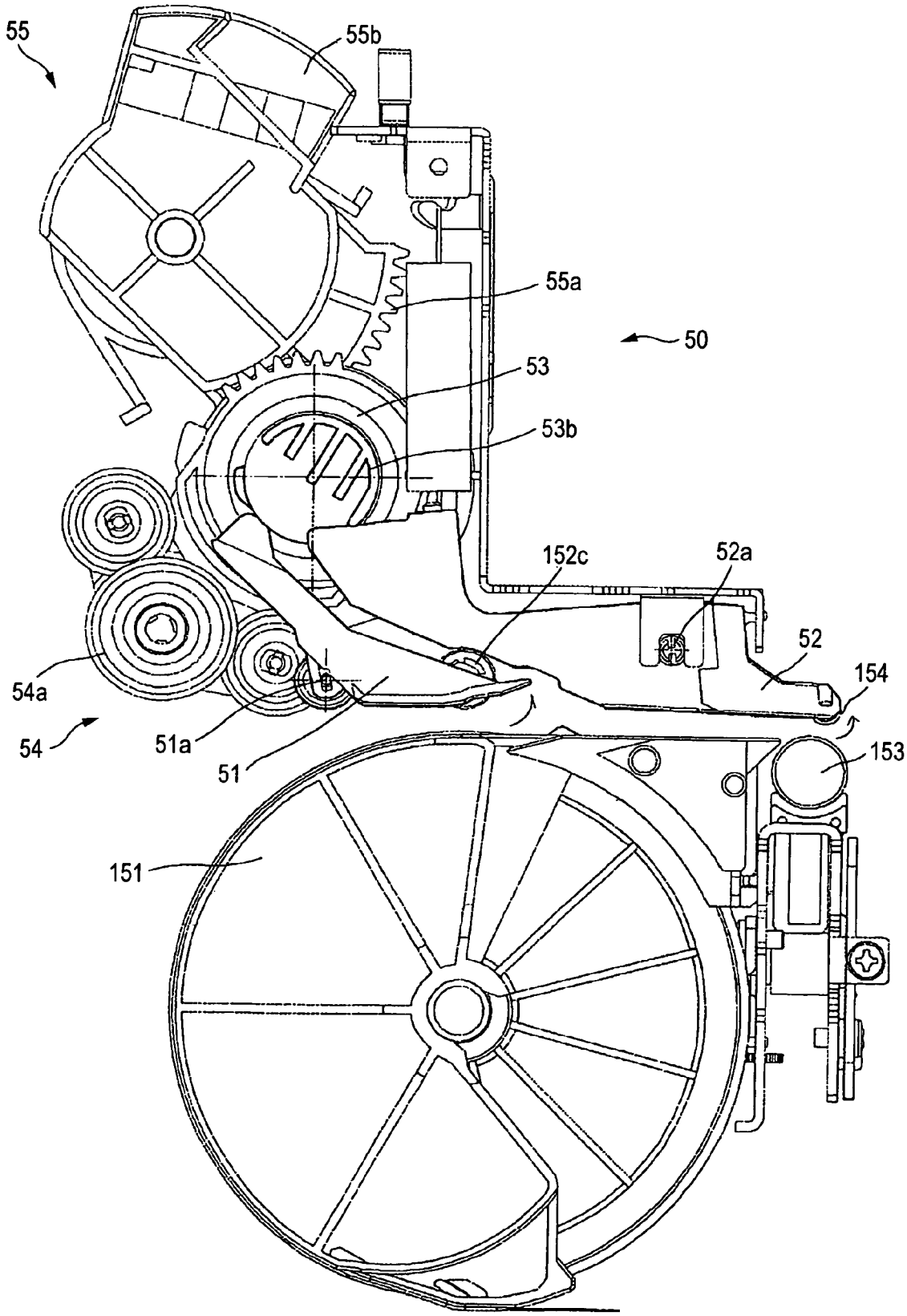

FIGS. 11 and 12 show a case that the follower rollers 152*c* and 154 are caused to operate simultaneously. FIG. 11 shows a state that the follower roller 152*c* is in contact with the sub roller 151 and the follower roller 154 is in contact with the sheet feeding roller 153. In this state, the planetary gear 54*a* is separated from the intermittent gear 53*c* and the cam 53*a* is separated from the other end of the pivoting member 51 (not shown in FIG. 11). The lever 55*b* is located at the contact position, and the cam 53*b* is separated from the other end of the pivoting member 52.

FIG. 12 shows a state that the lever 55*b* is moved manually from the contact position to a release position, whereby the gear 55*a* is meshed with the intermittent gear 53*d* and rotates the latter. As a result, the cam 53*a* (not shown in FIG. 12) pushes the other end of the pivoting member 51 and hence the follower roller 152*c* which is pivotally supported by the pivoting member 51 at the one end is separated from the sub roller 151. Further, since the cam 53*b* pushes the other end of the pivoting member 52 and hence the follower roller 152*c* which is rotatably supported by the pivoting member 52 at the one end is separated from the sheet feeding roller 153.

When a sheet or paper is supplied, to reliably deliver it from the sub roller 151 to the sheet feeding roller 153, it is necessary that as shown in FIG. 11 the follower roller 152*c* be in contact with the sub roller 151 and the follower roller 154 be in contact with the sheet feeding roller 153. On the other hand, when a sheet is fed manually, it is necessary that as shown in FIG. 12 the follower rollers 152*c* and 154 be separated from the sub roller 151 and the sheet feeding roller 153, respectively, because the sheet would interfere with the follower rollers 152*c* and 154 if the follower rollers 152*c* and 154 were in contact with the sub roller 151 and the sheet feeding roller 153, respectively.

Figure 14:
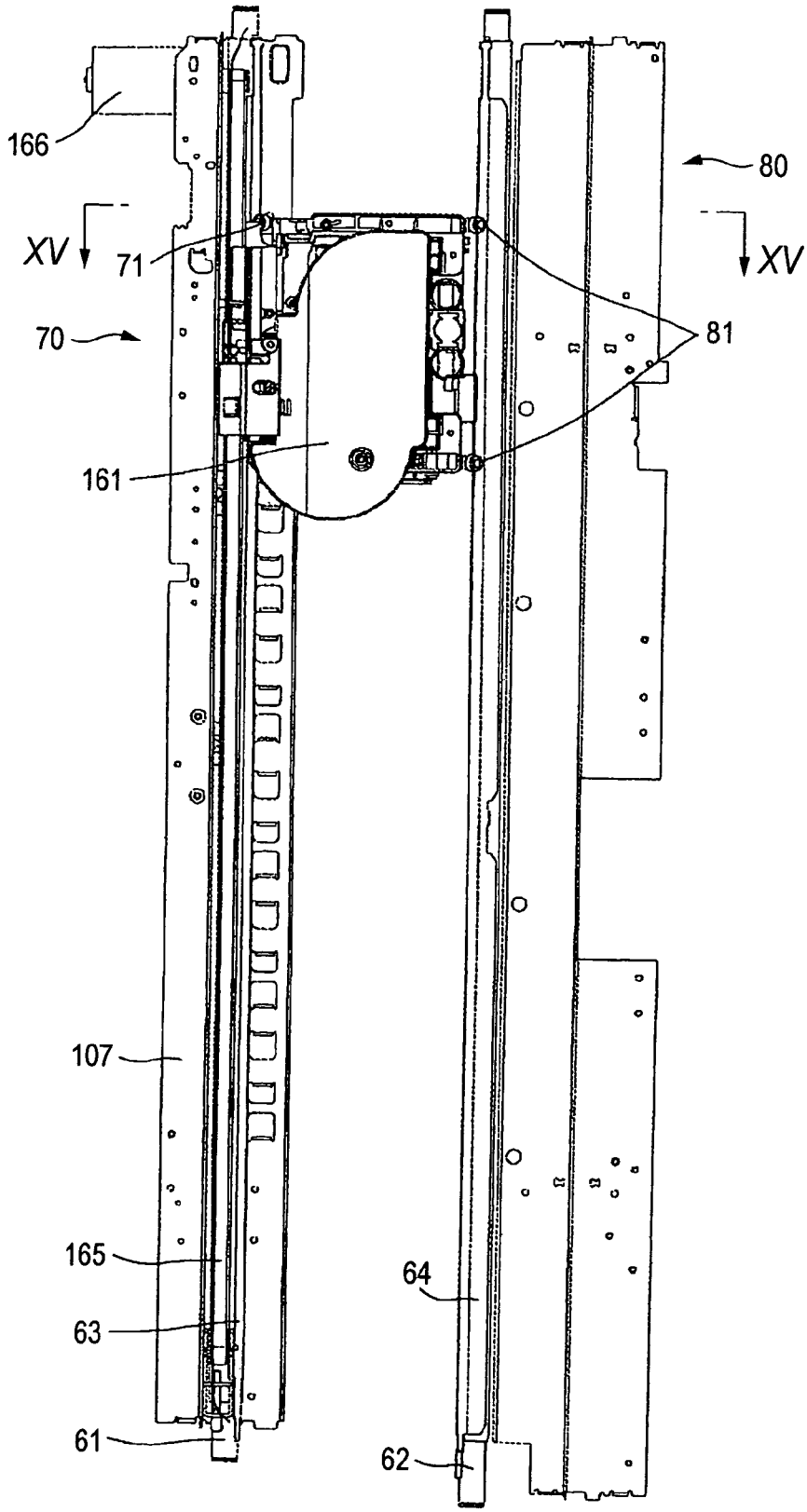
FIG. 14 is a plan view of the configuration shown in FIG. 13.
Figure 15:
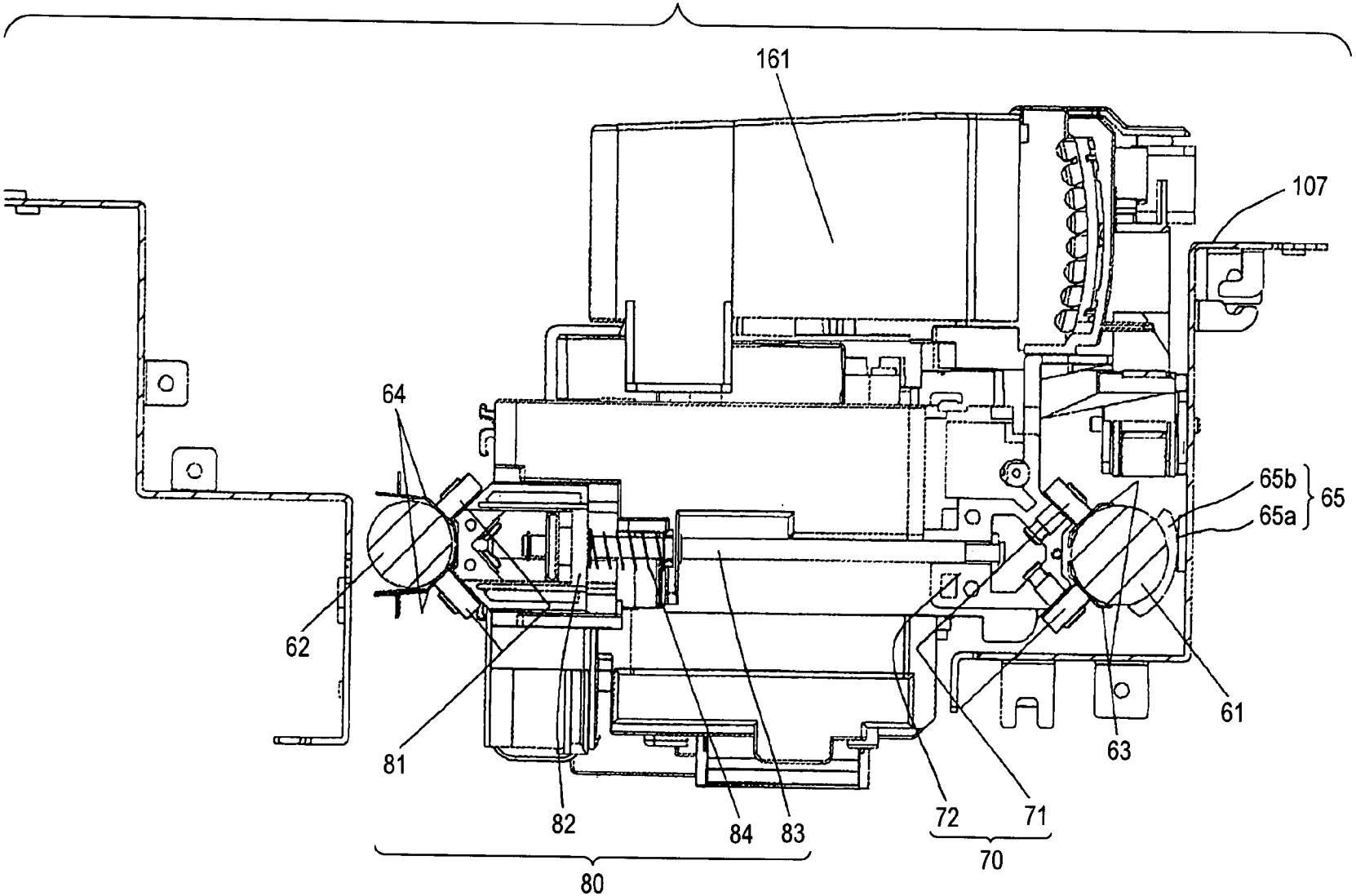
FIG. 15 is a section view taken along a line XV-XV in FIG. 14.

As shown in FIGS. 13-15, the main guide shaft 61 is disposed behind the carriage 161 so as to extend in the primary scanning direction and the auxiliary guide shaft 62 is disposed in front of the carriage 161 so as to extend approximately parallel with the main guide shaft 61. The main guide shaft 61 and the auxiliary guide shaft 62 assume circular rod shapes, and both ends of each of the main guide shaft 61 and the auxiliary guide shaft 62 are supported by and fixed to side frames (not shown).

The main guide shaft 61 is provided with main guide plates 63 that assume long rectangle shapes and extend from one end to the other end of the main guide shaft 61, and the auxiliary guide shaft 62 is provided with auxiliary guide plates 64 that assume long rectangle shapes and extend from one end to the other end of the auxiliary guide shaft 62. More specifically, two main guide plates 63 are arranged side by side in the circumferential direction so as to cover an approximately half, carriage-161-side circumferential face of the main guide shaft 61, and two auxiliary guide plates 64 are arranged side by side in the circumferential direction so as to cover an approximately half, carriage-161-side circumferential face of the auxiliary guide shaft 62. That is, the two main guide plates 63 and the two auxiliary guide plates 64 are arranged so as to cover top portions and bottom portions of the approximately half, confronting circumferential faces of the main guide shaft 61 and the auxiliary guide shaft 62.

Both longer-side end portions of each main guide plate 63 and those of each auxiliary guide plate 64 are slightly bent toward the main guide shaft 61 or the auxiliary guide shaft 62 so as to form a generally C-shaped cross section. With this sectional shape, when the main guide plates 63 and the auxiliary guide plates 64 are attached to the circumferential faces of the main guide shaft 61 and the auxiliary guide shaft 62, both longer-side end portions of each main guide plate 63 and those of each auxiliary guide plate 64 contact the circumferential face of the main guide 61 or the auxiliary guide 62 and central portions of the main guide plates 63 and the auxiliary guide plates 64 are slightly separated from the circumferential faces of the main guide shaft 61 and the auxiliary guide shaft 62 to provide play between them. Both ends of each main guide plate 63 and those of each auxiliary guide plate 64 are also supported by the above-mentioned side frames, and providing play in these support portions enables sheet metal alignment.

The carriage 161 is provided with slide members 70 having the same structure on the back side at the two end positions in the primary scanning direction, as well as with slide members 80 having the same structure on the front side at the two end positions in the primary scanning direction. In each slide member 70, two radial bearings 71 are attached to a fixed seat 72 that is screwed to the carriage 161 and are arranged and oriented so as to form approximately a right angle in the vertical plane containing those. That is, the two radial bearings 71 are supported by the fixed seat 72 so as to be brought into contact with the two respective main guide plates 63 attached to the main guide shaft 61 and to be able to slide in the longitudinal direction of the main guide plates 63.

In each slide member 80, two radial bearings 81 are attached to a movable seat 82 that is movably attached to the carriage 161 and are arranged and oriented so as to form approximately a right angle in the vertical plane containing those. That is, the two radial bearings 81 are pivotally supported by the movable seat 72 so as to be brought into contact with the two respective auxiliary guide plates 64 attached to the auxiliary guide shaft 62 and to be able to slide in the longitudinal direction of the auxiliary guide plates 64. One end portion of each of shafts 83 is fixed to the fixed seat 72 and the other end portion penetrates through the movable seat 82 with a spring 84 interposed in between. The movable seats 82 are thus movable along the respective shafts 83. Play that occurs when each movable seat 82 is moved can be eliminated by adjusting the length of the support portion of the shaft 83 that is close to the movable seat 82.

With the above-configured carriage 161, the slide members 70 and 80 do not directly contact the main guide shaft 61 and the auxiliary guide shaft 62, respectively, which prevents wear of the main guide shaft 61 and the auxiliary guide shaft 62. Therefore, the reciprocation of the carriage 161 in the primary scanning direction can be kept highly accurate. Wear of the main guide plates 63 and the auxiliary guide plates 64 can also be reduced by making those of a material that is less prone to wear such as stainless steel, which also contributes to keeping the reciprocation of the carriage 161 in the primary scanning direction highly accurate.

Since the radial bearings 81 of the slide members 80 press on the auxiliary guide plates 64 attached to the auxiliary guide shaft 62 because of the restorative forces of the springs 84, the reaction forces cause the radial bearings 71 of the slide members 70 to press on the main guide plates 63, whereby the main guide plates 63 are bent by an amount corresponding the play and are pressed against the main guide shaft 61. Therefore, the carriage 161 always slides along the main guide shaft 61 and its reciprocation in the main direction is kept highly accurate. The use of the radial bearings 71 and 81 instead of conventional thrust bearings contributes to cost reduction.

Since as described above both ends of the main guide shaft 61 are supported by and fixed to the side frames, the main guide shaft 61 may be bent by the loads from the springs 84 that act on the main guide shaft 61 in its radial direction. In view of this, a support member 65 for sustaining the above loads is disposed behind the center of the main guide shaft 61. However, the main guide shaft 61 is made rotatable about an eccentric rotation axis so that the gap between the nozzle formation face of the recording head 162 mounted on the carriage 161 and the recording face of a sheet or paper being transported on the guide face 163*a* of the platen 163 is always kept constant even if the sheet or paper thickness is varied. Therefore, if a simple support member were disposed behind the center of the main guide shaft 61, a gap might occur between the support member and the main guide shaft 61 depending on the rotation position of the main guide shaft 61. To prevent occurrence of such a gap, the support member 65 has the following structure.

Figure 16:
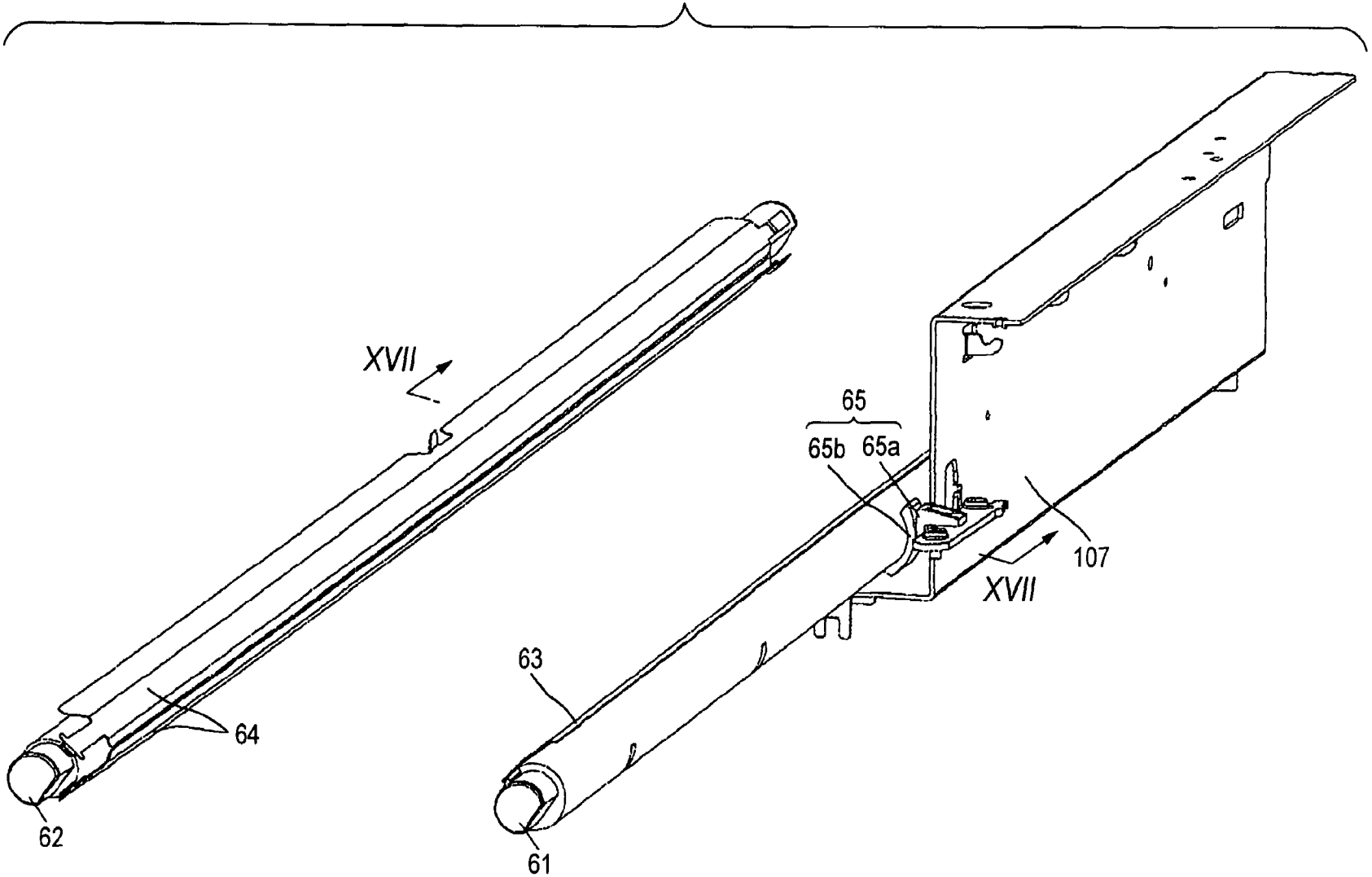
FIG. 16 is a perspective view showing details of a supporting member shown in FIG. 13.

As shown in FIG. 16, the support member 65 is provided with a press member 65*a* and an adjustment member 65*b*. The press member 65*a* is screwed to a frame 107 that is disposed behind the main guide shaft 61. The adjustment member 65*b* is partially buried in the rear side of the main guide shaft 61 at the center. The press member 65*a* and the adjustment member 65*b* contact each other and thereby sustain the loads from the springs 84 that act on the main guide shaft 61 in its radial direction.

Figure 17:
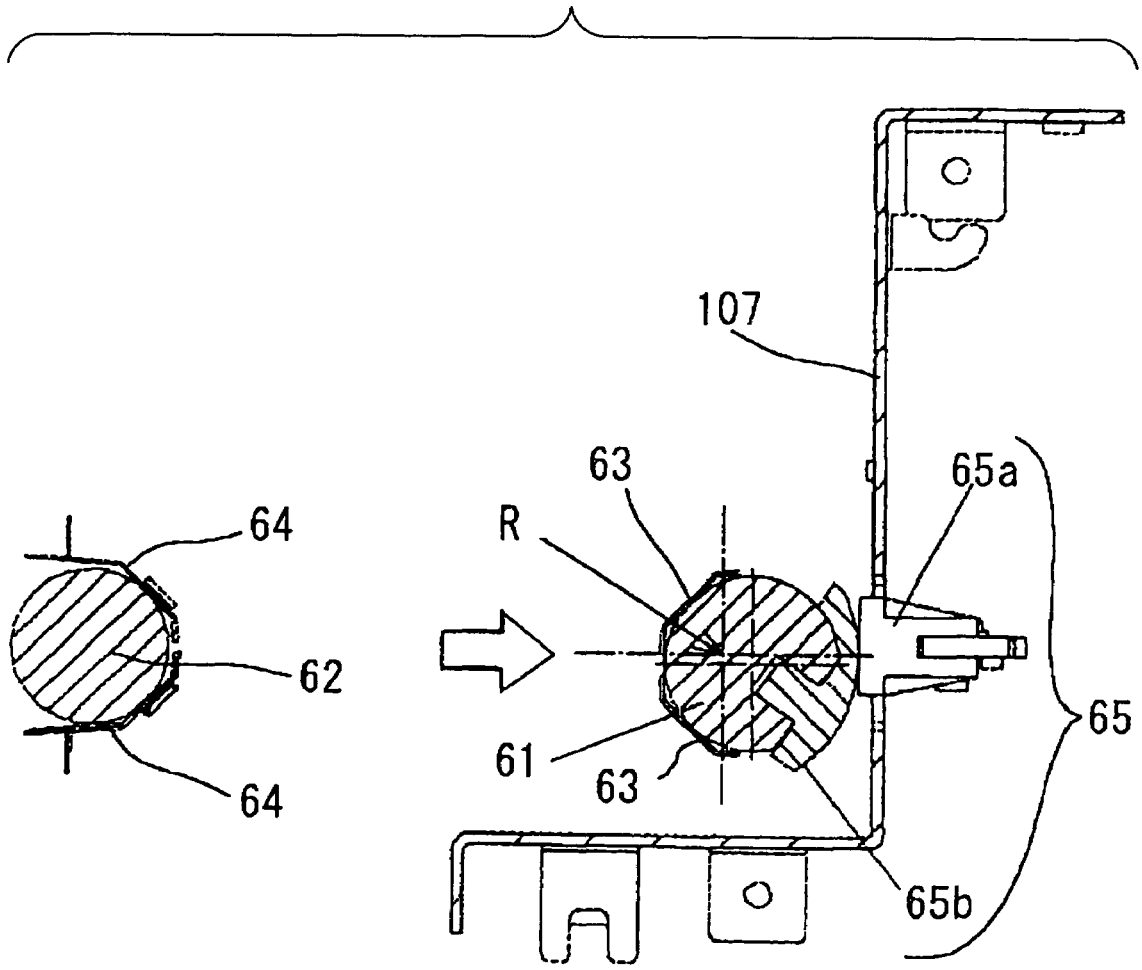
FIG. 17 is a section view taken along a line XVII-XVII in FIG. 16.

Whereas the contact face of the press member 65*a* is flat, the contact face of the adjustment member 65*b* has a curved face whose distance from the eccentric rotation axis R of the main guide shaft 61 is always kept constant, that is, does not vary depending on the rotation position. With this measure, no gap is formed between the support member 65 and the main guide shaft 61 even if the above-mentioned gap adjustment is performed by rotating the main guide shaft 61 about the eccentric rotation axis. Therefore, the support member 65 can always sustain the loads (indicated by an arrow in FIG. 17) from the springs 84 that act on the main guide shaft 61 in its radial direction. The main guide shaft 61 is prevented from being bent by the loads and hence the recording accuracy can be kept high.

As shown in FIG. 18 to FIGS. 21A and 21B, the platen gap adjustment mechanism 170 is equipped with eccentric bushings 171*a*, 171*b*, 172*a*, and 172*b* that support the main guide shaft 61 and the auxiliary guide shaft 62 in an eccentric manner, a belt 173 for synchronously rotating the eccentric bushings 171*a* and 172*a* that are located on one side, and tension pulleys 174 that act on the belt 173 from both sides to give tension to it. The platen gap adjustment mechanism 170 is also equipped with a motor 175, a gear unit 176 for coupling the motor 175 to the eccentric bushings 171*a* and 172*a*, and first fixing members 177 and a second fixing member 178 that fix the main guide shaft 61 and the auxiliary guide shaft 62.

Figure 19A:
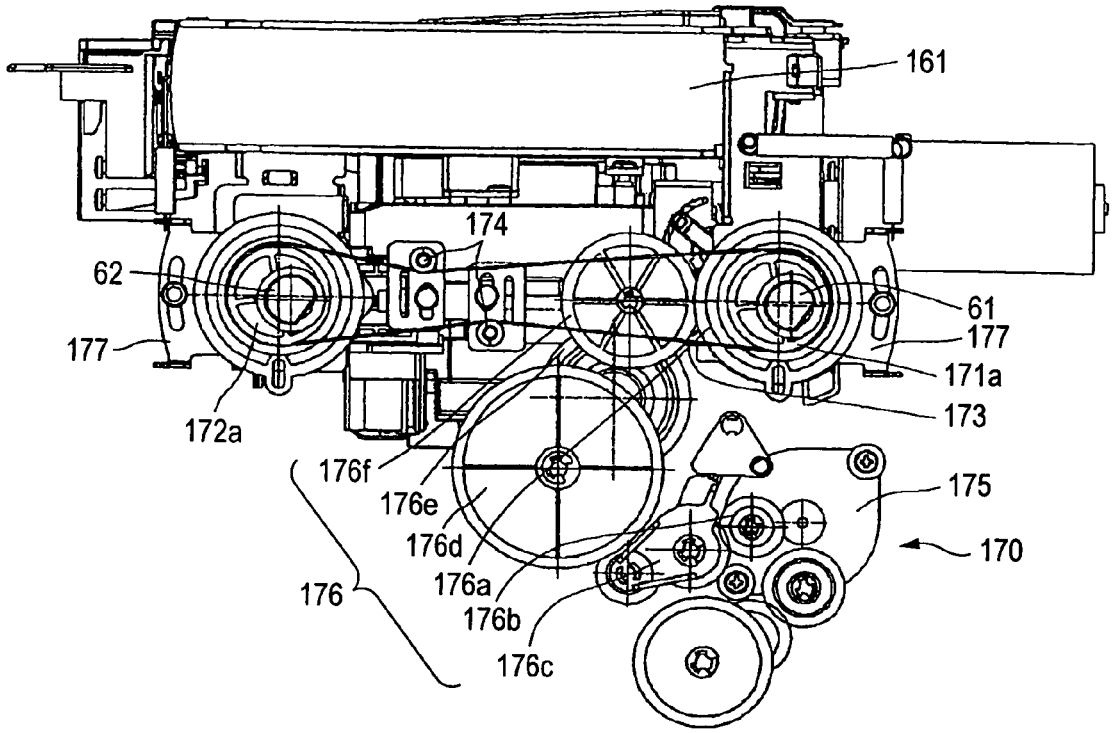
FIG. 19A is a right side view of the configuration shown in FIG. 18.
Figure 19B:
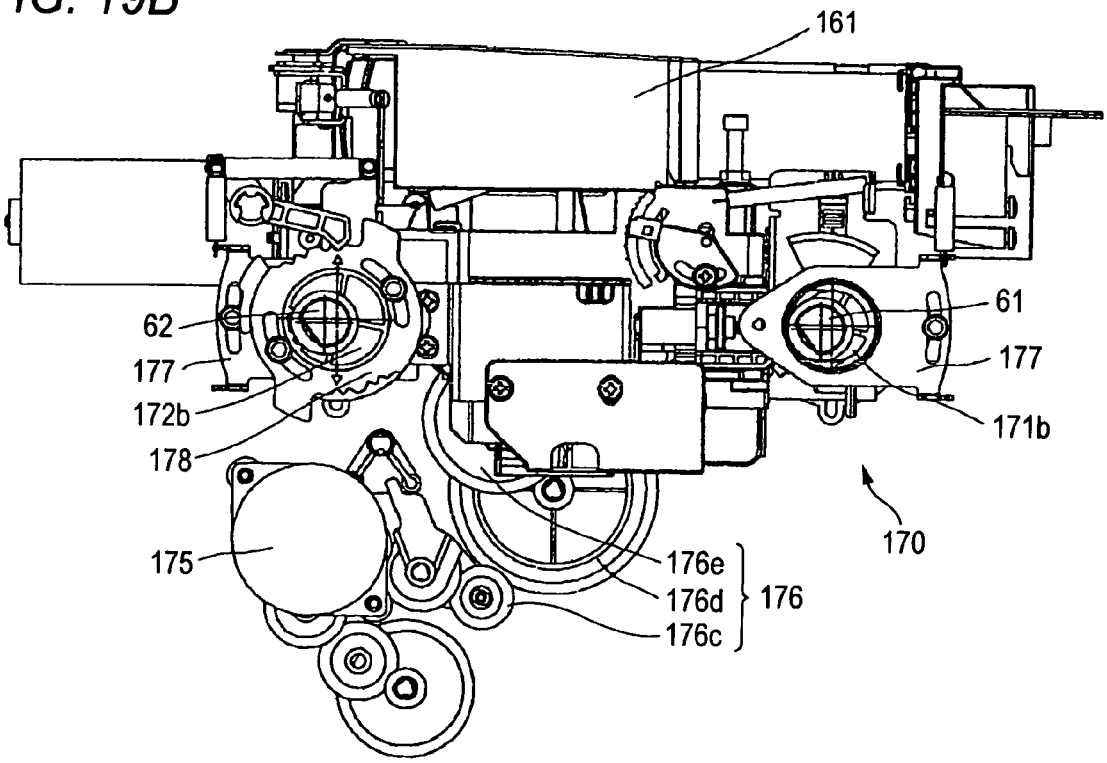
FIG. 19B is a left side view of the configuration shown in FIG. 18.
Figure 20:
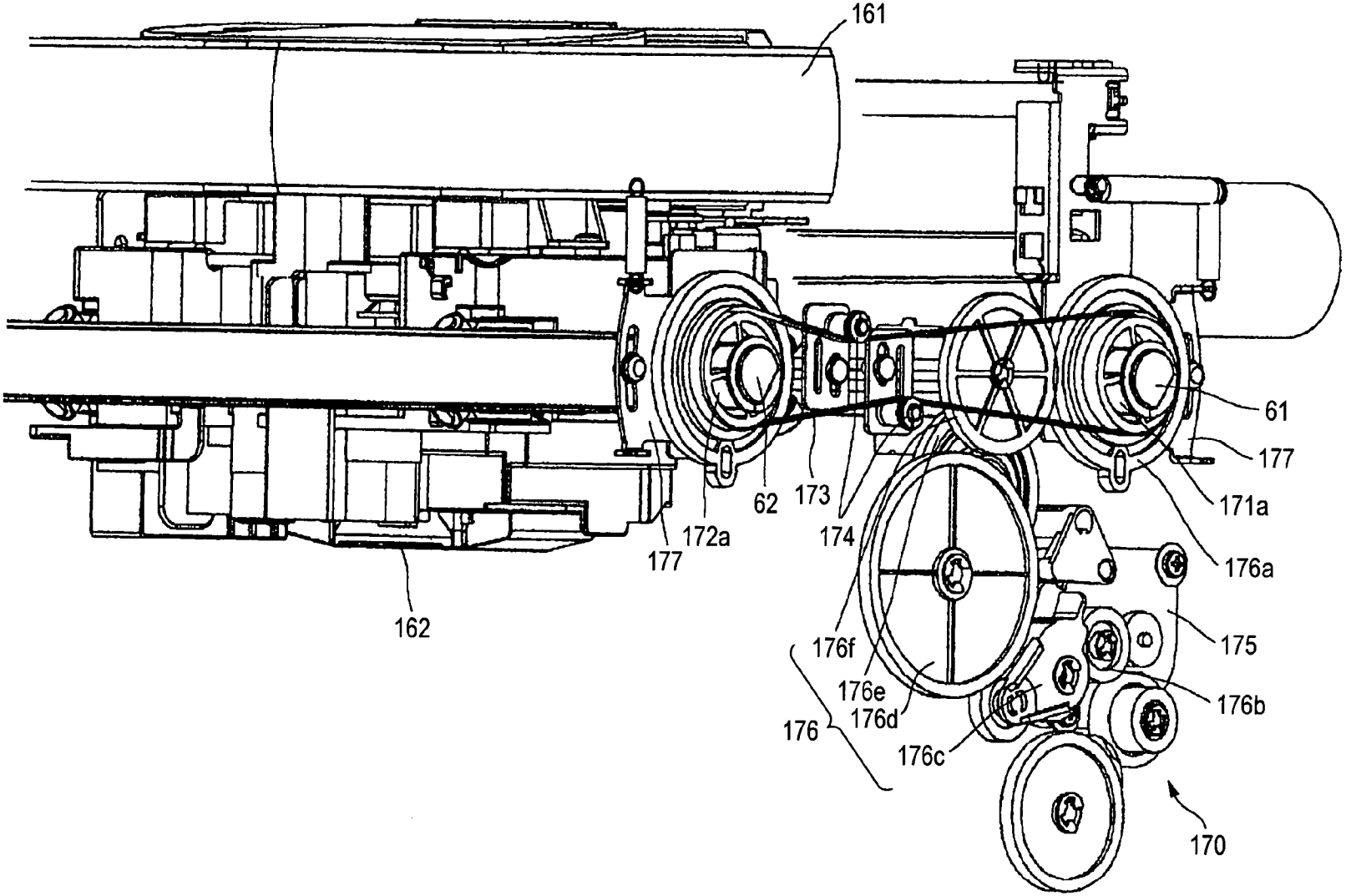
FIG. 20 is a perspective view of the configuration shown in FIG. 19A.
Figure 21A:
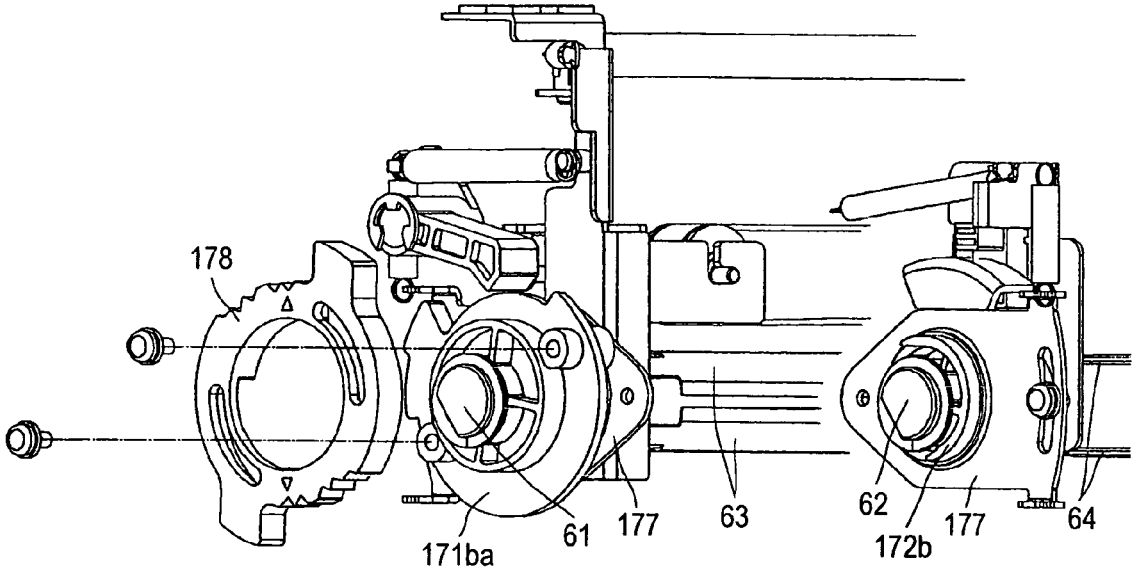
FIGS. 21A and 21B are perspective views of the configuration shown in FIG. 19B.
Figure 21B:
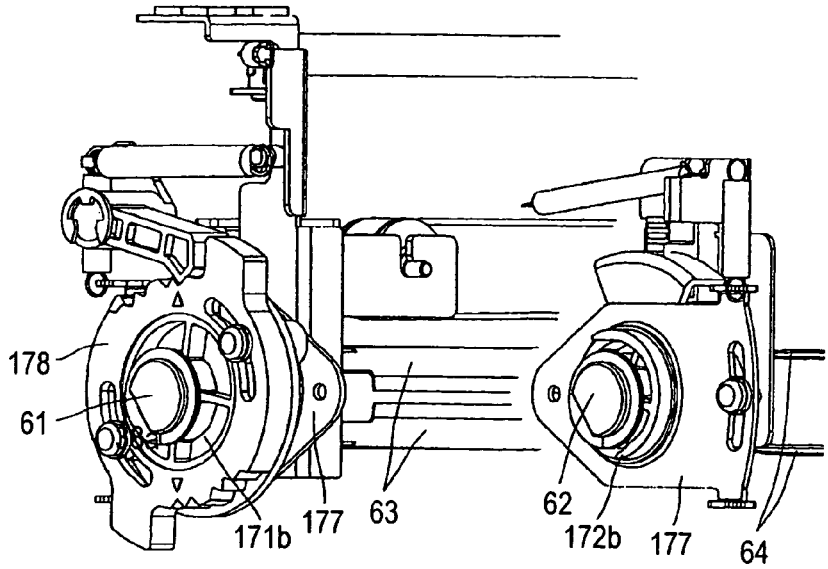

As shown in FIG. 18 to FIGS. 21A and 21B, the two ends of the main guide shaft 61 and the two ends of the auxiliary guide shaft 62 are fixed to the eccentric bushings 171*a*, 171*b*, 172*a*, and 172*b*, respectively, and the eccentric bushings 171*a*, 171*b*, 172*a*, and 172*b* are attached rotatably to the two side frames (not shown). This enables eccentric rotation of the main guide shaft 61 and the auxiliary guide shaft 62. As shown in FIGS. 18-20, the belt 173 is stretched between the eccentric bushings 171*a* and 172*a*, which prevents backlash that would otherwise occur in the case where gears are used. The tension pulleys 174 are screwed to the side frame (not shown), which prevents a phase deviation between the main guide shaft 61 and the auxiliary guide shaft 62 when they rotate.

As shown in FIGS. 18-20, the gear unit 176 is provided with a bushing gear 176*a* that is fitted with one end of the eccentric bushing 171*a*, a first intermediate gear 176*b* that is in mesh with the motor 175, a planetary gear 176*c* that is in mesh with the first intermediate gear 176*b*, a second intermediate gear 176*d* that meshes with the planetary gear 176*c* intermittently, a third intermediate gear 176*e* that is in mesh with the second intermediate gear 176*d*, and a fourth intermediate gear 176*f* that is in mesh with the third intermediate gear 176*e*. The planetary gear 176*c* has a function of switching between the gap adjustment driving and the switching driving for the switching shafts 14 and 22 plus the release driving for the follower rollers 152*a*, 152*b*, and 152*c* in accordance with the normal/reverse rotation of the motor 175.

As shown in FIG. 18 to FIGS. 21A and 21B, the first fixing members 177 are fixed to the respective eccentric bushings 171*a*, 171*b*, 172*a*, and 172*b*. The first fixing members 177 are screwed to the two side frames (not shown) after the horizontality of the plane defined by the first guide shaft 61 and the second guide shaft 62 is adjusted. As shown in FIGS. 18 and 19B and FIGS. 21A and 21B, the second fixing member 178 is attached to the eccentric bushing 171*b* that is located on the other side. The second fixing member 178 is screwed to a flange 171*ba* that is integral with the eccentric bushing 171*b* after a gap adjustment is performed by eccentric rotation of the main guide shaft 61 and the second guide shaft 62.

During a gap adjustment, the carriage 161 is moved in the vertical direction, which may cause deviation of the main guide plates 63 and the auxiliary guide plates 64 that are provided between the main guide shaft 61 and the second guide shaft 62. However, since the main guide plates 63 and the auxiliary guide plates 64 are attached to the side frames with some play, simplified sheet metal alignment can be performed. Complete sheet metal alignment can then be performed by leveling the main guide plates 63 and the auxiliary guide plates 64 by reciprocating the carriage 161 in the primary scanning direction.

With the above-configured platen gap adjustment mechanism 170, the carriage 161 can be moved in the vertical direction by automatically rotating the main guide shaft 61 and the auxiliary guide shaft 62 in phase in an eccentric manner. Therefore, a highly accurate gap adjustment can be performed so that the gap between the nozzle formation face of the recording head 162 mounted on the carriage 161 and the recording face of a sheet or paper being transported on the guide face 163*a* of the platen 163 is always kept constant even if the sheet or paper thickness is varied.

During a gap adjustment, a recognition sensor of the carriage 161 is moved in the vertical direction in synchronism with a vertical movement of the carriage 161. A linear encoder scale that is part of a position sensor for the carriage 161 needs to be kept out of contact with a linear encoder that is attached to the carriage 161. Therefore, a mechanism is provided that makes it possible to adjust the position of the linear encoder scale by using levers that are attached to the two respective sides of the linear encoder scale.

Figure 23:
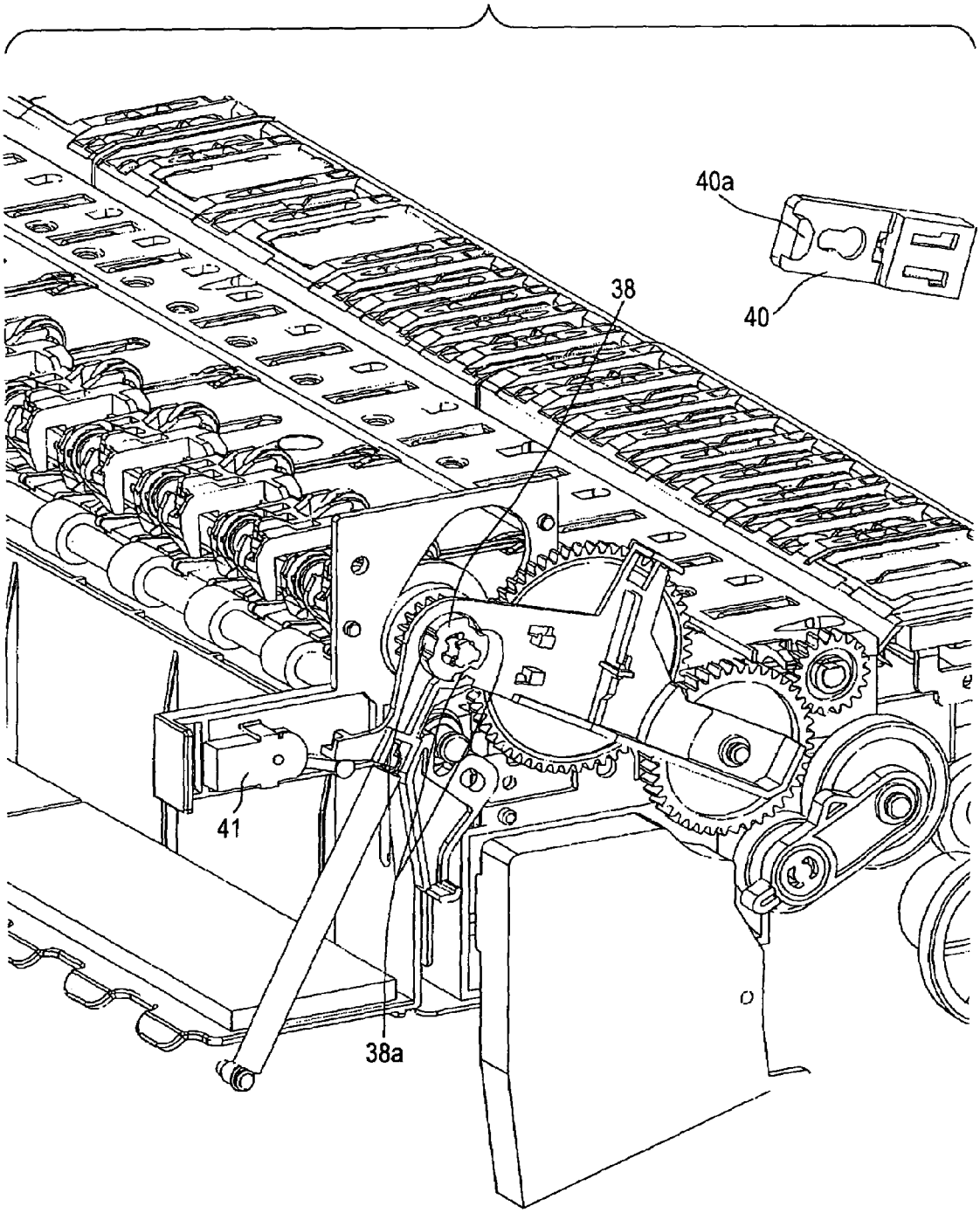

FIGS. 22 and 23 show a detailed structure of the follower roller unit 156. FIG. 23 is different from FIG. 22 in that a lever 40 is removed. The two ends of the switching shaft 14 are pivotally supported by respective frames 15 so as to be movable in elliptical holes 15*a* that are formed in the respective frames 15. Plural sets of a spur roller 11, a smooth roller 12, and a release portion 13 (see FIG. 5) where neither the spur roller 11 nor the smooth roller 12 is provided are arranged in the axial direction at prescribed intervals. In each set, the spur roller 11, the smooth roller 12, and the release portion 13 are disposed around the switching shaft 14 at prescribed intervals in the circumferential direction.

The switching shaft 14 of the follower roller unit 156 and the switching shaft 22 of the support rib unit 164 are rotated in link with each other by a gear unit 30. The gear unit 30 is equipped with a roller gear 31 that is fitted with one end of the switching shaft 14, a rib gear 32 that is fitted with one end of the switching shaft 22, a first intermediate gear 33 and a second intermediate gear 34 that are in mesh with each other and with the roller gear 31 and the rib gear 32, respectively, and a planetary gear 35 that meshes with the second intermediate gear 34 intermittently. The planetary gear 35 has a function of switching between the switching driving for the switching shafts 14 and 22 and the release driving for the follower rollers 152*a*, 162*b*, and 152*c* in accordance with the normal/reverse rotation of the motor (not shown).

Figure 24C:
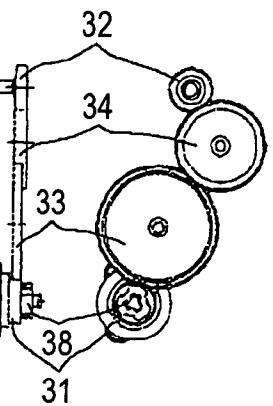
FIG. 24C is a right side view of the follower roller unit and the supporting rib unit.
Figure 24B:
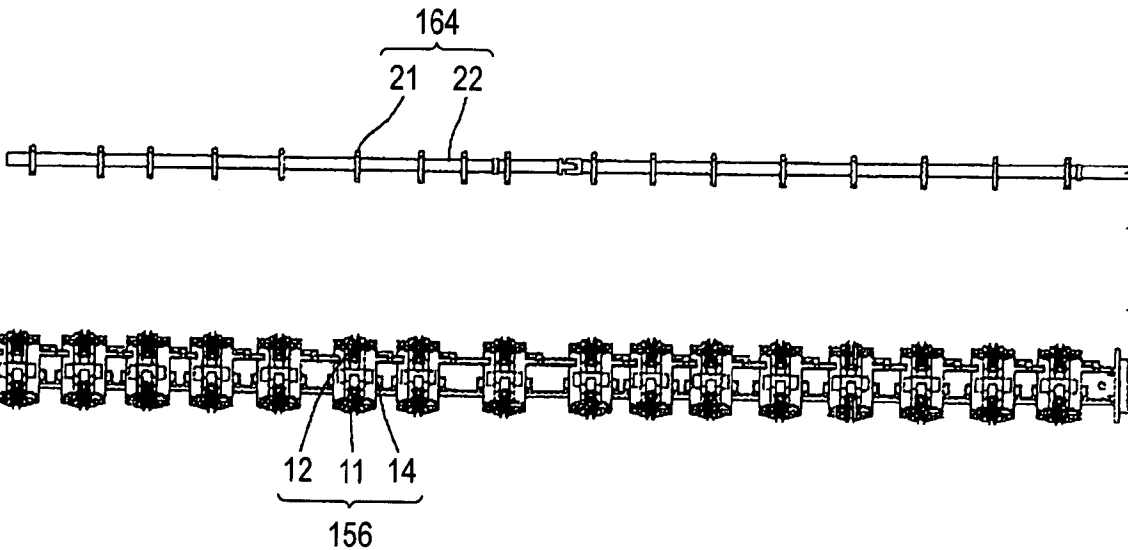
FIG. 24B is a plan view of the follower roller unit and the supporting rib unit.
Figure 24A:
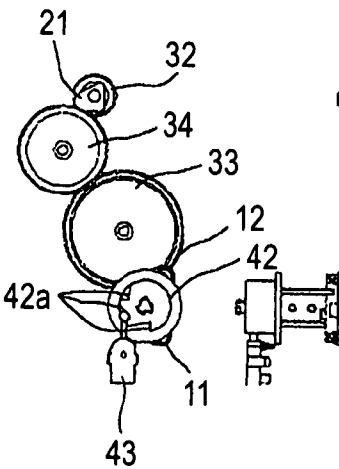
FIG. 24A is a left side view of the follower roller unit and the supporting rib unit.

The gear unit 30 is also equipped with an arm 37 that supports the respective shafts of the first intermediate gear 33 and the second intermediate gear 34 and is connected to the frame 15 via a spring 36, a positioning cam 38 (see FIG. 23) that is fitted with the one end of the switching shaft 14, a positioning lever 40 that is connected to the arm 37 via a spring 39 and is locked with the cam 38, and a limit switch 41 that is turned on or off in accordance with the position of the arm 37. As shown in FIGS. 24A-24C, a phase detection cam 42 that is fitted with the other end of the switching shaft 14 and a limit switch 43 that is turned on or off in accordance with the rotation position of the phase detection cam 42 are also provided.

The spring 36 urges the arm 37 downward, whereby the switching shaft 14 is ordinarily placed at the bottom stationary positions in the holes 15*a*. The circumferential face of the positioning cam 38 is formed with three positioning cuts 38*a* that correspond to switching positions for the switching shaft 14, that is, switching positions for the spur rollers 11, the smooth rollers 12, and the release portions 13. The positioning lever 40 is provided with, at one end, a projection 40*a* that is to engage with the positioning cuts 38*a* of the positioning cam 38. The positioning lever 40 is slidably attached to the side face of the arm 37 so that the projection 49*a* can slide along the circumferential face of the positioning cam 38.

The spring 39 urges the positioning lever 40 in the sliding direction, whereby the projection 40*a* of the positioning lever 40 is always pressed against the circumferential face of the positioning cam 38. The circumferential face of the phase detection cam 42 is formed with three phase detection cuts 42*a* that correspond to switching positions for the switching shaft 14, that is, switching positions for the spur rollers 11, the smooth rollers 12, and the release portions 13.

With the above gear unit 30, the drive force of the motor 175 is transmitted to the rib gear 32 via the planetary gear 35 and the second intermediate gear 34 as well as to the roller gear 31 via the planetary gear 35, the second intermediate gear 34, and the first intermediate gear 33. Therefore, the switching shafts 22 and 14 are rotated in link with each other, whereby the switching between the protrusion and retraction of the support ribs 21 and the switching between the spur rollers 11, the smooth rollers 12, and the release portions 13 can be performed simultaneously. Alternatively, instead of the gear unit, the switching shaft 14 of the follower roller unit 156 and the switching shaft 22 of the support rib unit 164 can be rotated in link with each other by using a pulley/belt mechanism.

When switching is performed between the spur rollers 11, the smooth rollers 12, and the release portions 13, the positioning cam 38 and the phase detection cam 42 rotate together with the switching shaft 14, the projection 40*a* of the positioning lever 40 is disengaged from one positioning cut 38*a* of the positioning cam 38 and slides along its circumferential face, and the lever of the limit switch 43 is disengaged from one phase detection cut 42*a* of the phase detection cam 42 and slides along its circumferential face. The fact that the switching operation is being performed can be detected reliably on the basis of a signal from the limit switch 43. If an abnormality that the switching shaft 14 goes up from the bottom stationary positions in the holes 15*a* occurs due to a certain external cause, the arm 37 is separated from the limit switch 41. Therefore, the occurrence of the abnormality can be detected reliably on the basis of a signal from the limit switch 41.

The switching between the spur rollers 11, the smooth rollers 12, and the release portions 13 is completed when the projection 40*a* of the positioning lever 40 is brought into engagement with another positioning cut 38*a* of the positioning cam 38 and the lever of the limit switch 43 is brought into engagement with another phase detection cut 42*a* of the phase detection cam 42. Since as described above the projection 40*a* of the positioning lever 40 is engaged with the positioning cuts 38*a* of the positioning cam 38, the spur rollers 11, the smooth rollers 12, and the release portions 13 can be set reliably to the prescribed phases. Further, the completion of the above switching operation can be detected reliably on the basis of a signal from the limit switch 43.

Figure 25A:
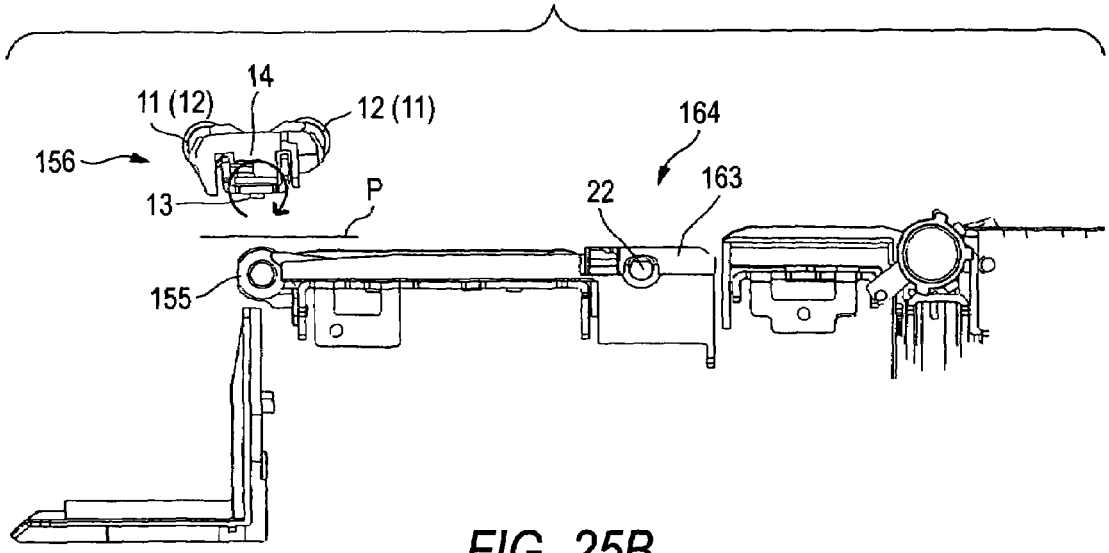
FIGS. 25A to 25C are side views showing state switching of the follower roller unit and the supporting rib unit.
Figure 25B:
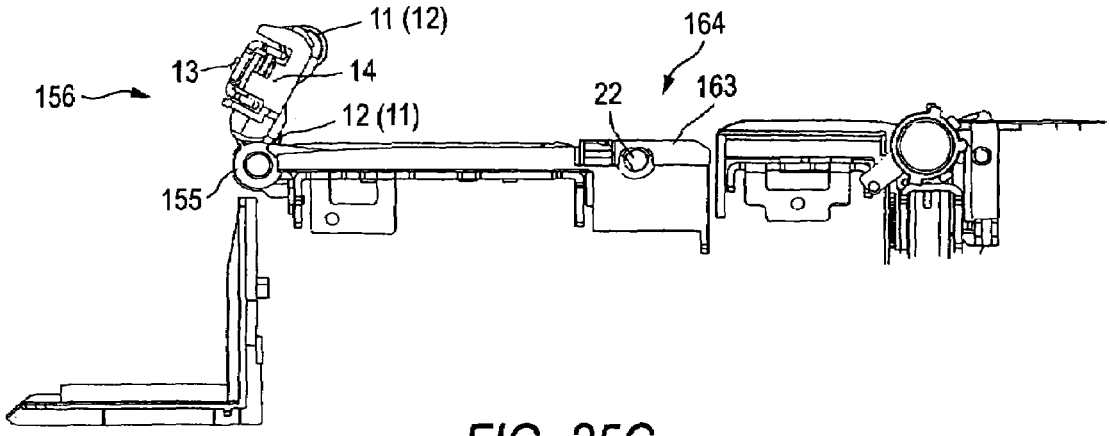

FIG. 25A shows a state that the follower roller unit 156 is switched to the release portions 13 and the spur rollers 11 and the smooth rollers 12 are separated from the sheet ejection roller 155 and that in the support rib unit 164 the support ribs 21 are retracted from the guide face 163*a* of the platen 163. FIG. 25B shows a state that the follower roller unit 156 is switched to the spur rollers 11 or the smooth rollers 12 and the spur rollers 11 or the smooth rollers 12 are in contact with the sheet ejection roller 155 and that in the support rib unit 164 the support ribs 21 are retracted from the guide face 163*a* of the platen 163.

Figure 25C:
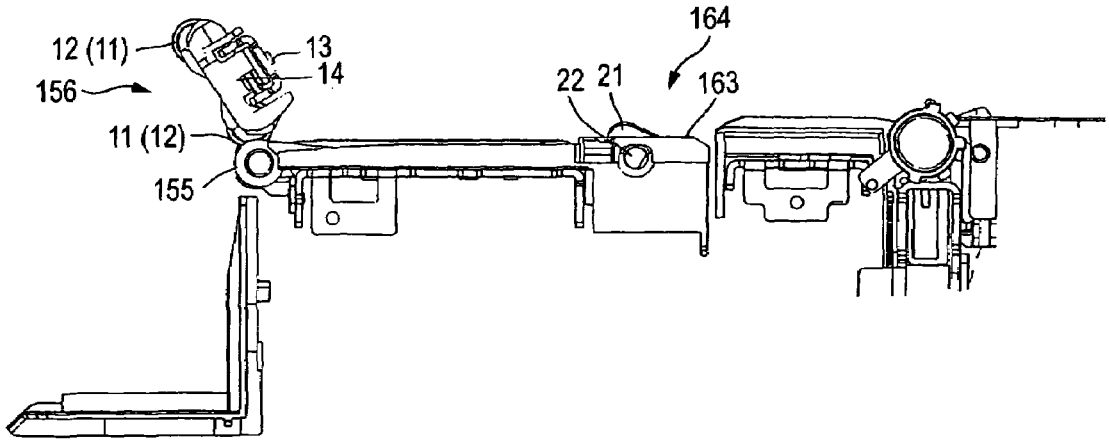

FIG. 25C shows a state that the follower roller unit 156 is switched to the spur rollers 11 or the smooth rollers 12 and the spur rollers 11 or the smooth rollers 12 are in contact with the sheet ejection roller 155 and that in the support rib unit 164 the support ribs 21 are protruded from the guide face 163*a* of the platen 163. This kind of switching makes it possible to realize a sheet ejection form that is most suitable for the attribute of a sheet or paper.

FIG. 26 is a table showing switching states of the follower roller unit 156 and the support rib unit 164 that correspond to respective attributes of sheets and paper. As shown in the row of condition 1, where the sheet or paper type is a cut sheet and the sheet or paper state is "normal," an optimum sheet ejection form can be realized by making switching to the spur rollers 11 and switching the support ribs 21 to a protruded state. This is because normal cut sheets are less prone to jag traces but tend to rise.

As shown in the row of condition 2, where the sheet or paper type is a cut sheet and the sheet or paper state is "delicate," an optimum sheet ejection form can be realized by making switching to the smooth rollers 12 and switching the support ribs 21 to a protruded state. This is because smooth rollers having smooth circumferential faces are less prone to scratch easy-to-scratch cut sheets.

As shown in the row of condition 3, where the sheet or paper type is a roll of paper and the sheet or paper state is "normal," an optimum sheet ejection form can be realized by making switching to the release portions 13 and switching the support ribs 21 to a retracted state. This is because normal rolled paper needs to be cut with a cutter and hence interference might occur if the spur rollers 11 or the smooth rollers 12 existed on the path, and normal rolled paper is curled and hence might rub against the support ribs 21 if they existed in the path.

As shown in the row of condition 4, where the sheet or paper type is a roll of paper and the sheet or paper state is "thin," an optimum sheet ejection form can be realized by making switching from the release portions 13 to the spur rollers 11 only during paper ejection and always keeping the support ribs 21 in a retracted state. This is because static electricity tends to occur in thin rolled paper and hence it may stick to the platen 163 or the like to become hard to eject, and thin rolled paper is curled and hence might rub against the support ribs 21 if they existed in the path.

As shown in the row of condition 5, where the sheet or paper type is a roll of paper and the sheet or paper state is "hygroscopic," an optimum sheet ejection form can be realized by keeping, from recording to paper ejection, a state that switching is made to the spur rollers 11 from the release portions 13 and switching the support ribs 21 to a retracted state. This is because highly hygroscopic roller paper tends to rise because of what is called cockling, and highly hygroscopic roller paper is curled and hence might rub against the support ribs 21 if they existed in the path.

As shown in the row of condition 6, where the sheet or paper type is a roll of paper and rolled paper is to be "cut shortly," an optimum sheet ejection form can be realized by making switching from the release portions 13 to the spur rollers 11 only during paper ejection and always keeping the support ribs 21 in a retracted state. This is because a short-cut part of rolled paper may play on the platen 163 and become hard to eject, and a short-cut part of rolled paper is curled and hence might rub against the support ribs 21 if they existed in the path.

As shown in the row of condition 7, where the sheet or paper type is a manual feed sheet and the sheet or paper state is "thick," an optimum sheet ejection form can be realized by making switching to the release portions 13 and switching the support ribs 21 to a retracted state. This is because thick manual feed sheets might interfere with the spur rollers 11, the smooth rollers 12, or the support ribs 21 if they existed in the path. The switching of the follower roller unit 156 and the support rib unit 164 can be performed automatically by storing the above kind of data in a control section of the ink jet printer 100 in the form of a table.

In the above-described embodiment, the switching shaft 14 of the follower roller unit 156 and the switching shaft 22 of the support rib unit 164 are rotated in link with each other by means of the gear unit 30. However, the invention is not limited to such a case. Separate gear units or the like may be provided so that the switching shaft 14 of the follower roller unit 156 and the switching shaft 22 of the support rib unit 164 are rotated independently of each other. Further, adaptation to many kinds of sheets and paper having respective attributes is possible even if only the follower roller unit 156 is provided, that is, the support rib unit 164 is not provided.

Figure 27:
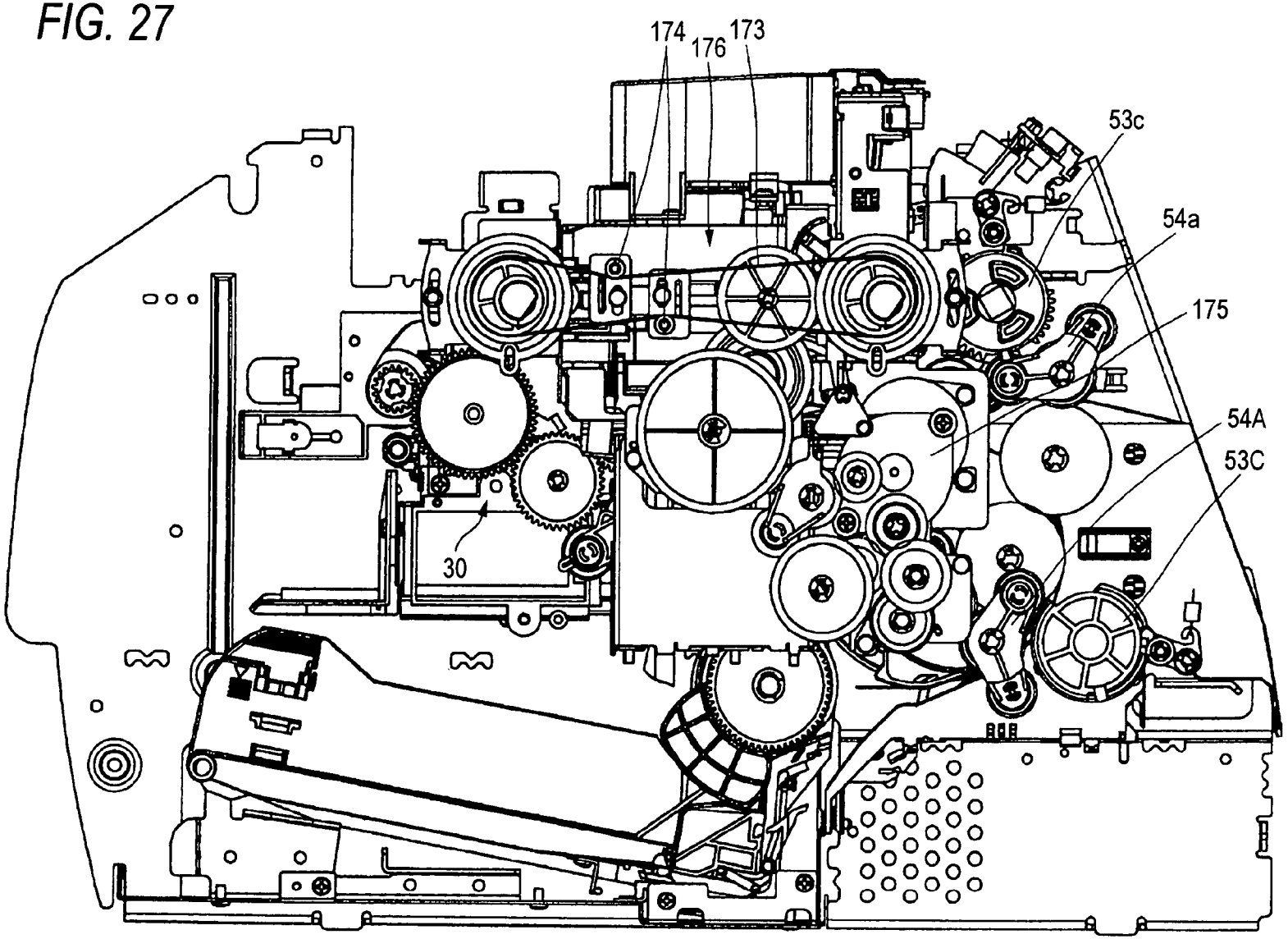
FIG. 27 is a side view showing an entire configuration of the follower roller driving device, the platen gap adjusting mechanism, and a driving mechanism for the follower roller unit and the supporting rib unit in the printer of FIG. 7.
Figure 28:
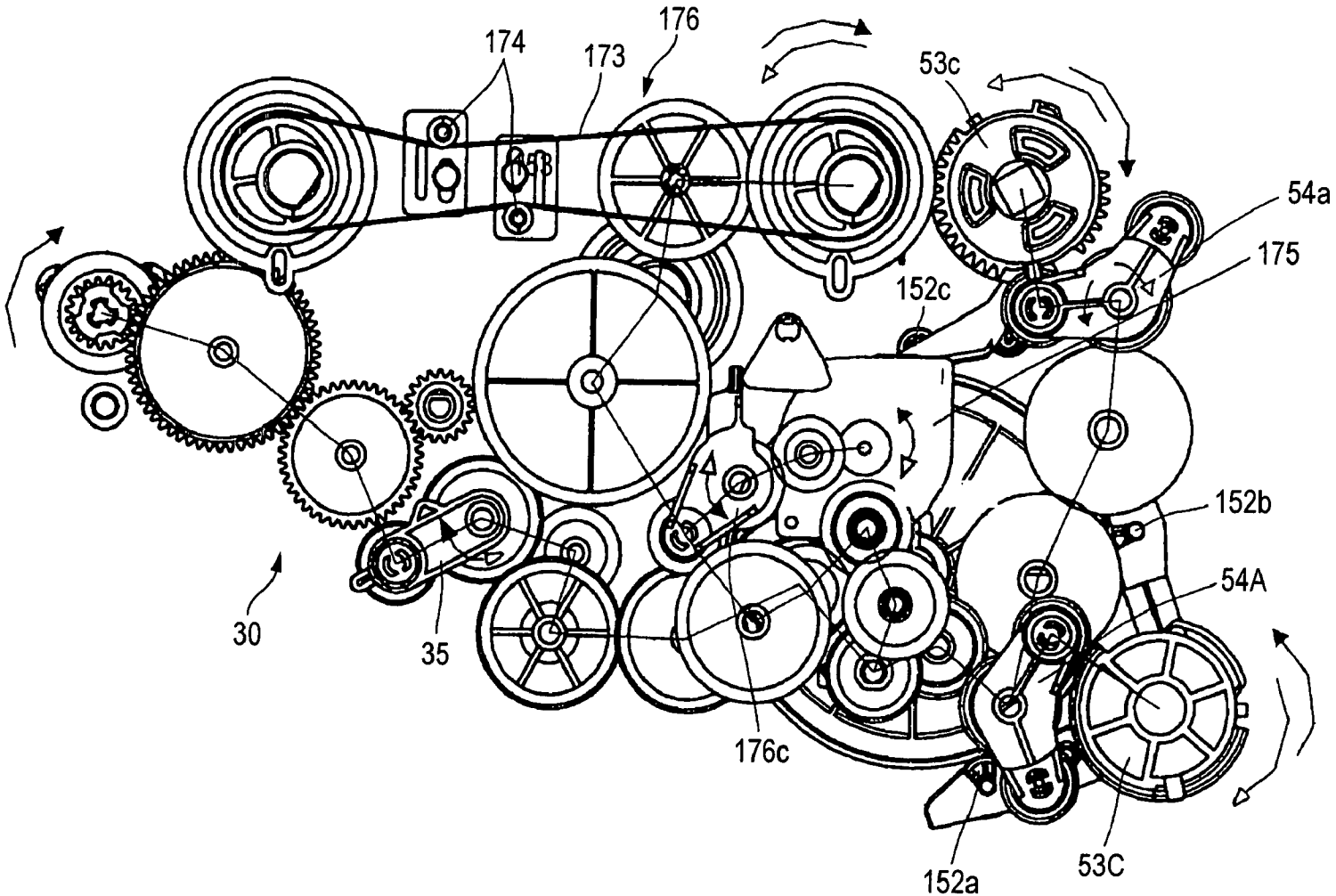
FIG. 28 is a view showing a main part of the configuration shown in FIG. 27.

As shown in FIGS. 27 and 28, the follower roller driving device 50 is equipped with the intermittent gear 53*c* and the planetary gear 54*a* for operating the follower roller 152*c* and an intermittent gear 53C and a planetary gear 54A for operating the follower rollers 152*a* and 152*b*. The platen gap adjustment mechanism 170 is equipped with the belt 173, the tension pulleys 174, and the gear unit 176. The follower roller unit 156 and the support rib unit 164 are coupled to the gear unit 30. The follower roller driving device 50, the platen gap adjustment mechanism 170, the follower roller unit 156, and the support rib unit 164 are driven and switched by the single motor 175.

More specifically, as shown in FIG. 28, if the motor 175 is rotated counterclockwise, the planetary gear 176*c* is moved to such a position as to be able to drive the follower roller driving device 50, the follower roller unit 156, and the support rib unit 164. In this state, if the motor 175 rotated clockwise, the planetary gear 35 is moved to such a position as to be able to drive the follower roller unit 156 and the support rib unit 164. If the motor 175 is rotated counterclockwise, the driving by the planetary gear 35 is suspended. On the other hand, when the motor 175 is rotated clockwise, the planetary gear 54A is moved to such a position as to separate the follower rollers 152*a* and 152*b* from the sub roller 151 and the planetary gear 54*a* is moved to such a position as to separate the follower roller 152*c* from the sub roller 151. When the motor 175 is rotated counterclockwise, the planetary gear 54A is moved to such a position as to bring the follower rollers 152*a* and 152*b* into contact with the sub roller 151 and the planetary gear 54*a* is moved to such a position as to bring the follower roller 152*c* into contact with the sub roller 151.

On the other hand, if first the motor 175 is rotated clockwise, the planetary gear 176*c* is moved to such a position as to be able to drive the platen gap adjustment mechanism 170. In this state, if the motor 175 is rotated clockwise, the platen gap (i.e., the distance between the head face and the platen 163) is increased. If the motor 175 is rotated counterclockwise, the platen gap is decreased.

Figure 30B:
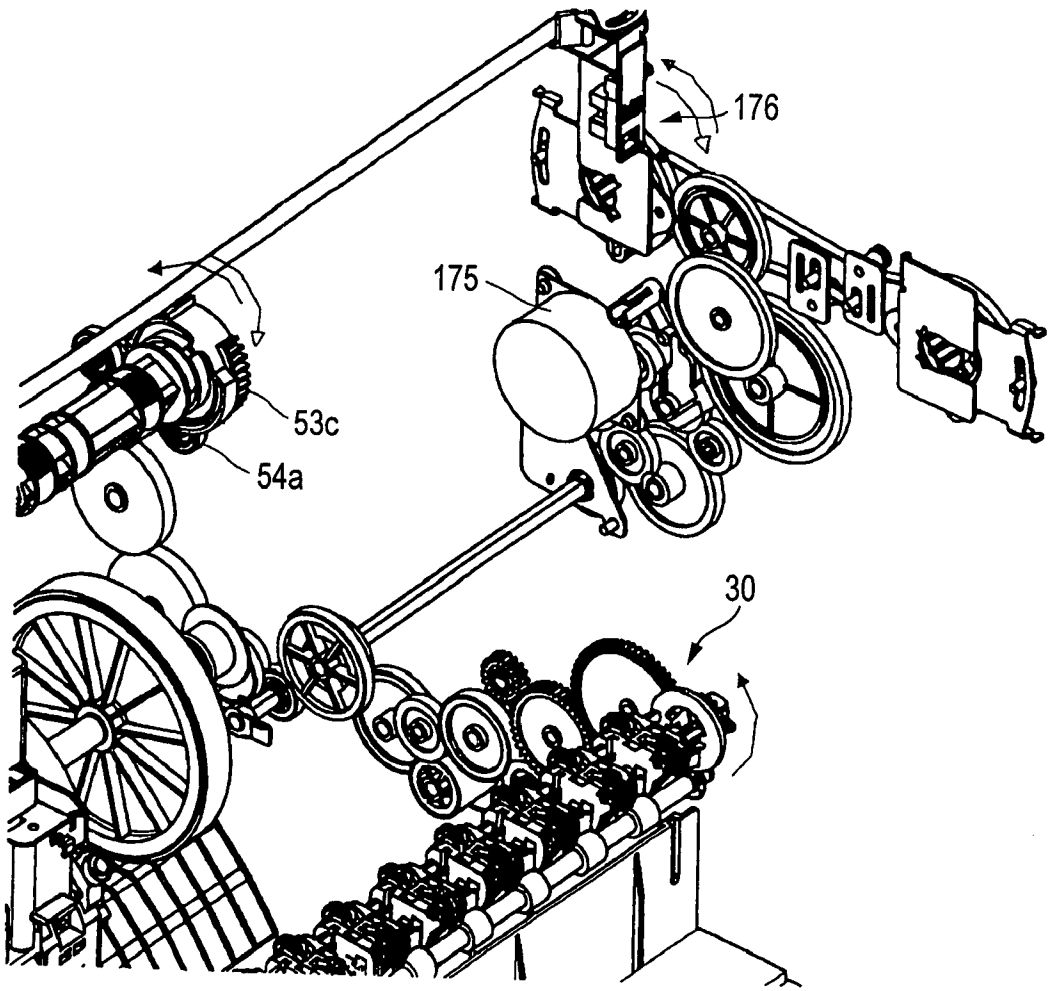
FIGS. 30A and 30B are views showing a main part of the configuration shown in FIG. 29.
Figure 30A:
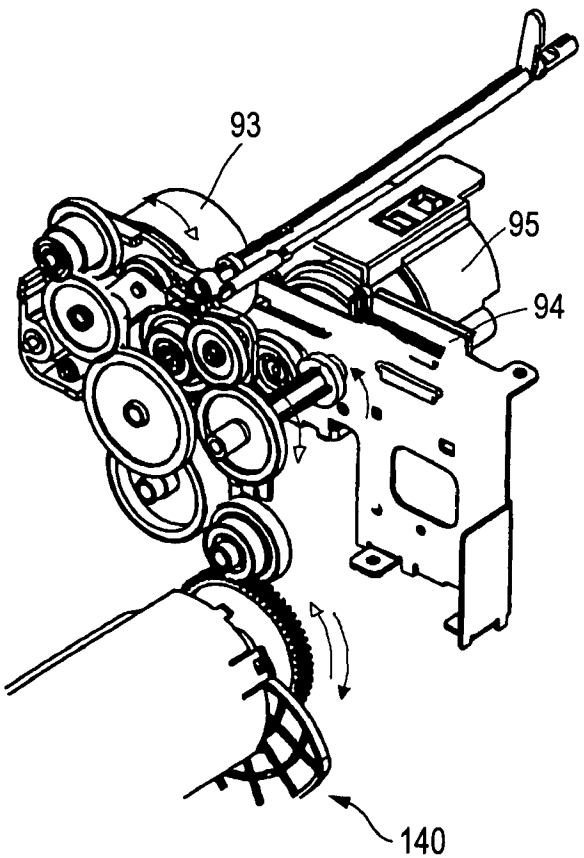

As shown in FIG. 30A, if first a motor 93 is rotated counterclockwise, a planetary gear 91 is moved to such a position as to be able to drive an automatic sheet supply mechanism including the hopper 141 and the sheet supply roller 142. In this state, if the motor 93 is rotated counterclockwise, the automatic sheet supply mechanism operates in the normal rotation direction. If motor 93 is rotated clockwise, the automatic sheet supply mechanism operates in the reverse rotation direction. On the other hand, if first the motor 93 is rotated clockwise, the planetary gear 91 is moved to such a position as to be able to drive a cleaning mechanism 90. In this state, if the motor 93 is rotated counterclockwise, a wiper 94 is driven. If motor 93 is rotated clockwise, a pump 95 is driven. FIG. 3GB is a perspective of the mechanisms shown in FIG. 28.

Figure 29:
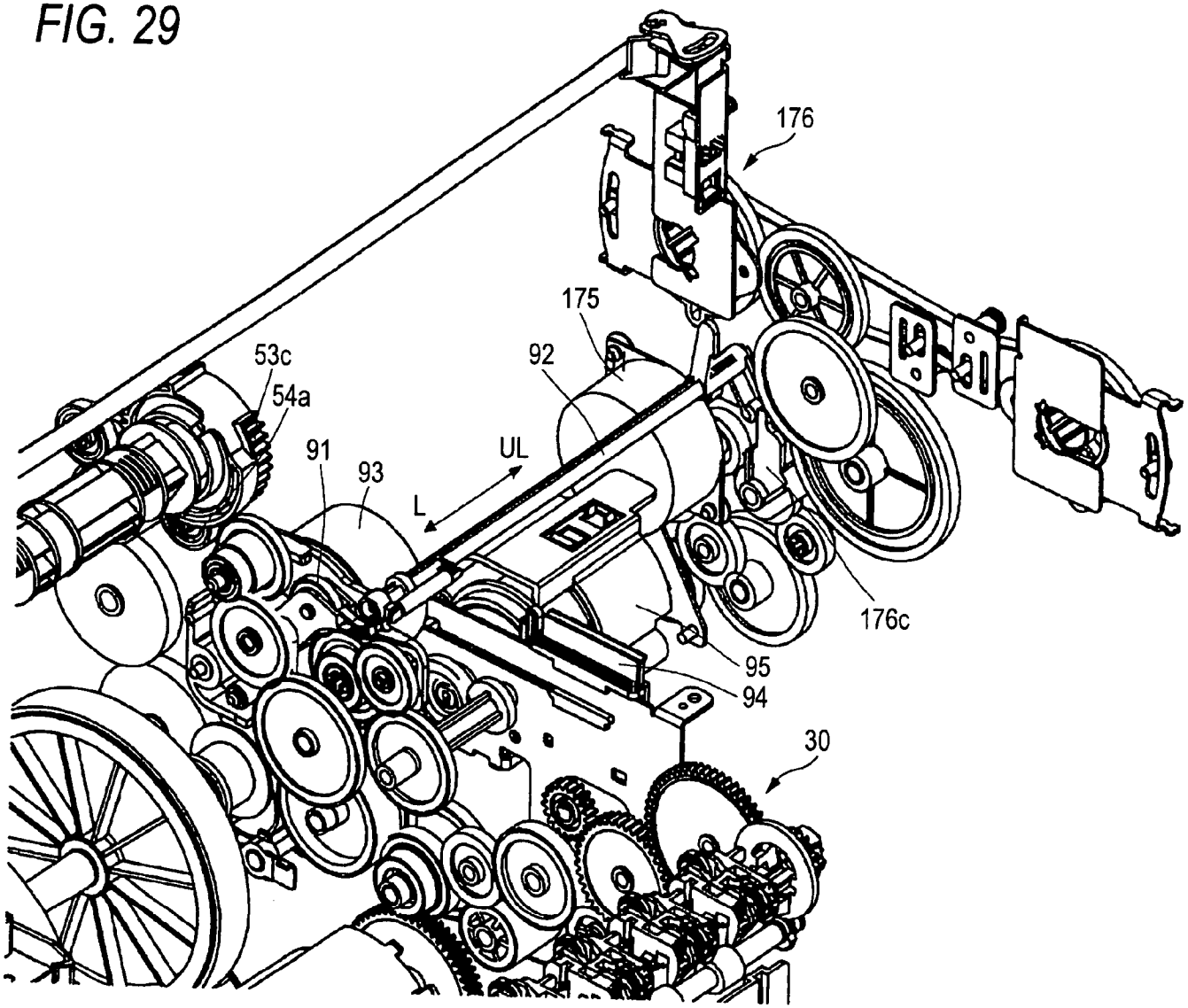
FIG. 29 is a perspective view showing an entire configuration of a mechanism for transmitting a driving force of a motor in the printer of FIG. 7.

The switching between the drive subject switching operation and the drive force transmitting operation that relate to the motors 175 and 93 is made by the carriage 161 being operated by a lever 92 shown in FIG. 29. For the drive subject switching operation, the lever 92 is moved to an unlock position (indicated by arrow UL). For the drive force transmitting operation, the lever 92 is moved to a lock position (indicated by arrow L).

Figure 31:
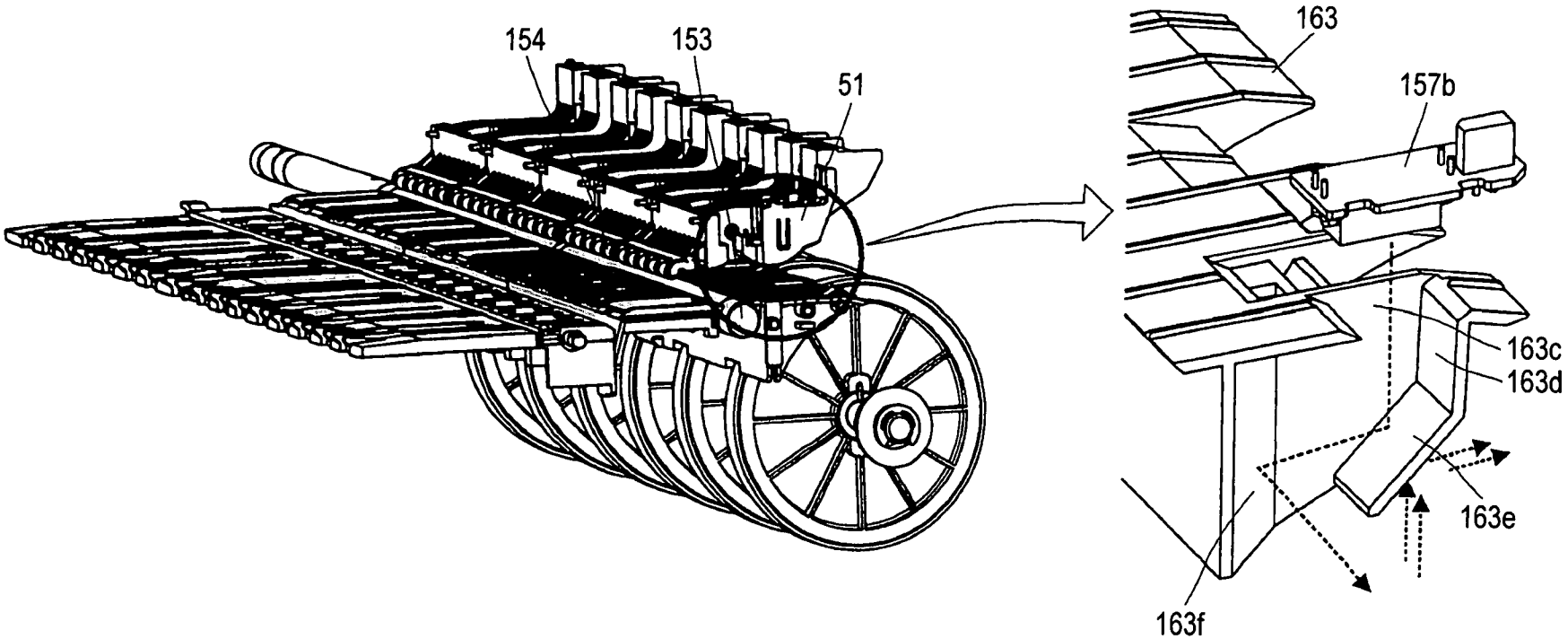
FIG. 31 is a perspective view showing a sensor and its periphery in the printers shown in FIGS. 1 and 7.
Figure 32A:
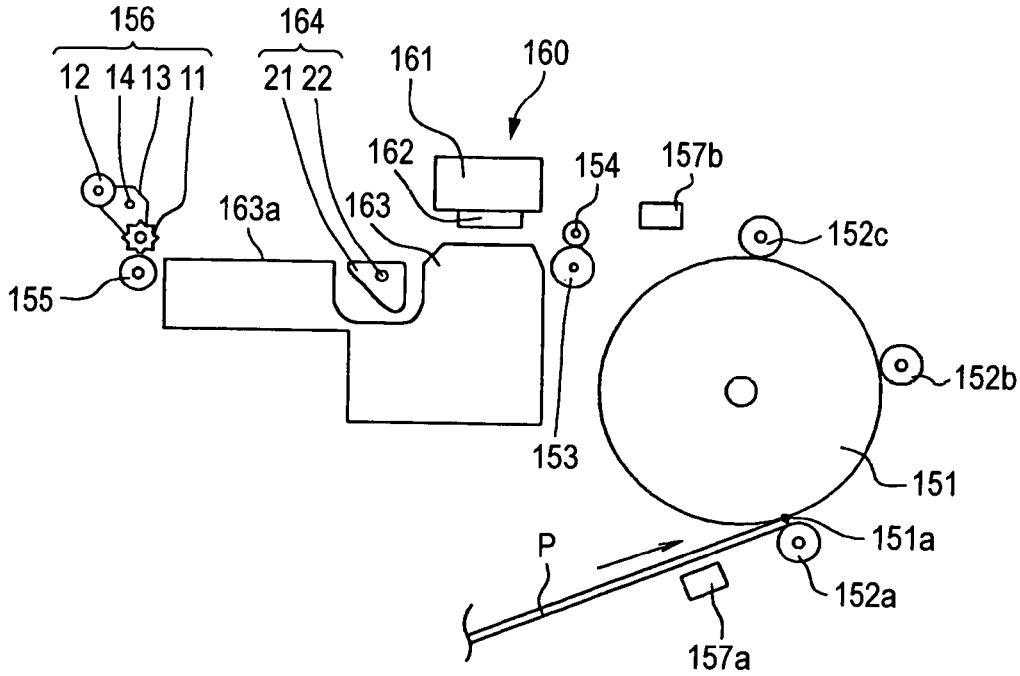
FIGS. 32A to 33B are schematic section views showing transporting operation of the sheet in the printer of FIG. 7.
Figure 32B:
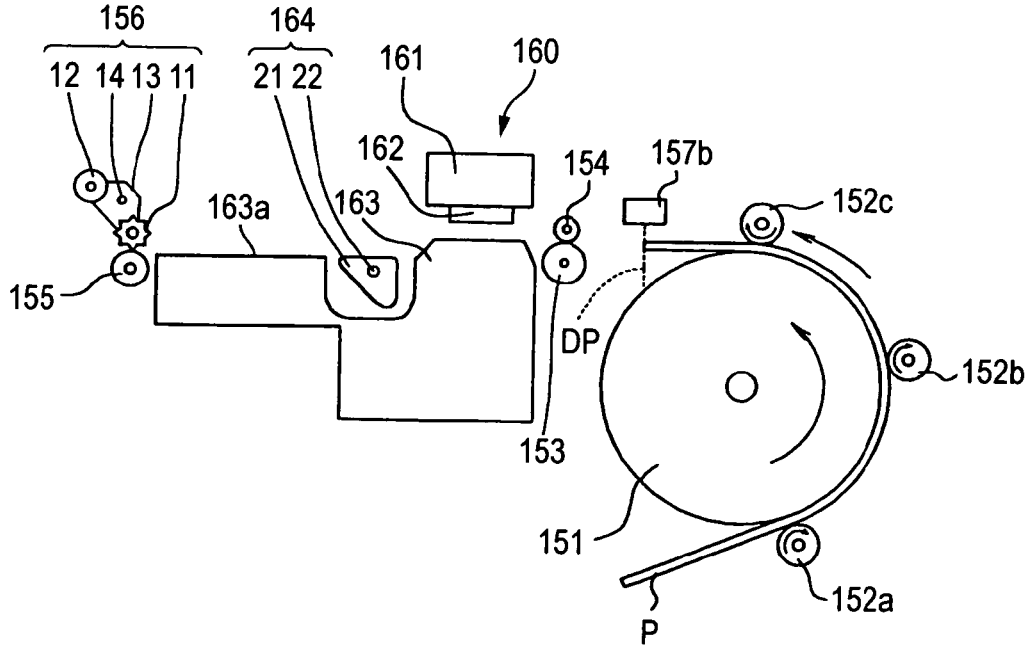
Figure 33A:
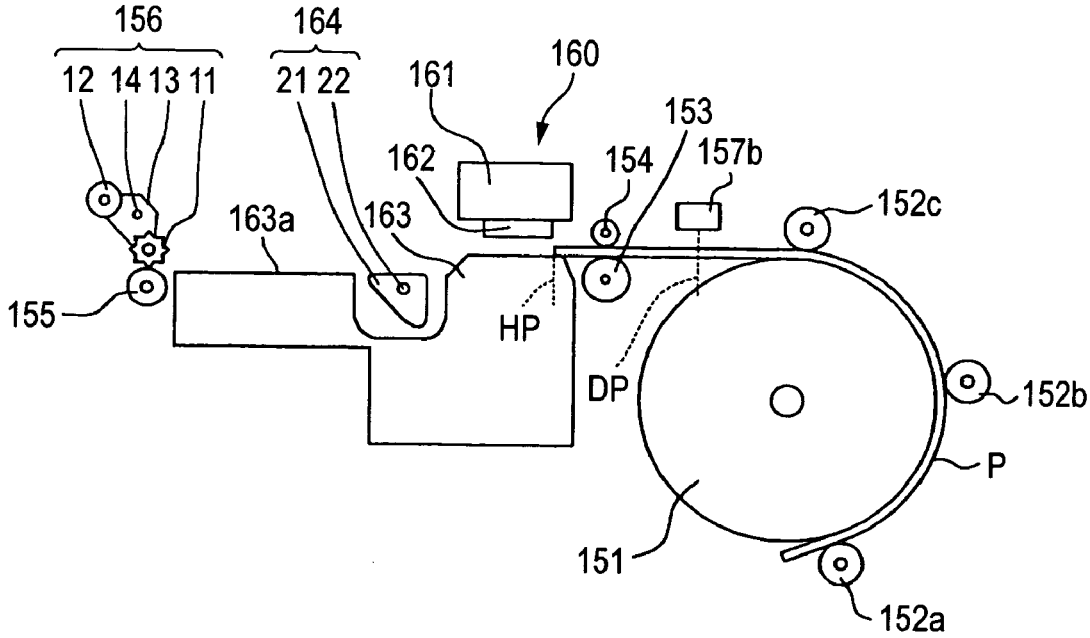
Figure 33B:
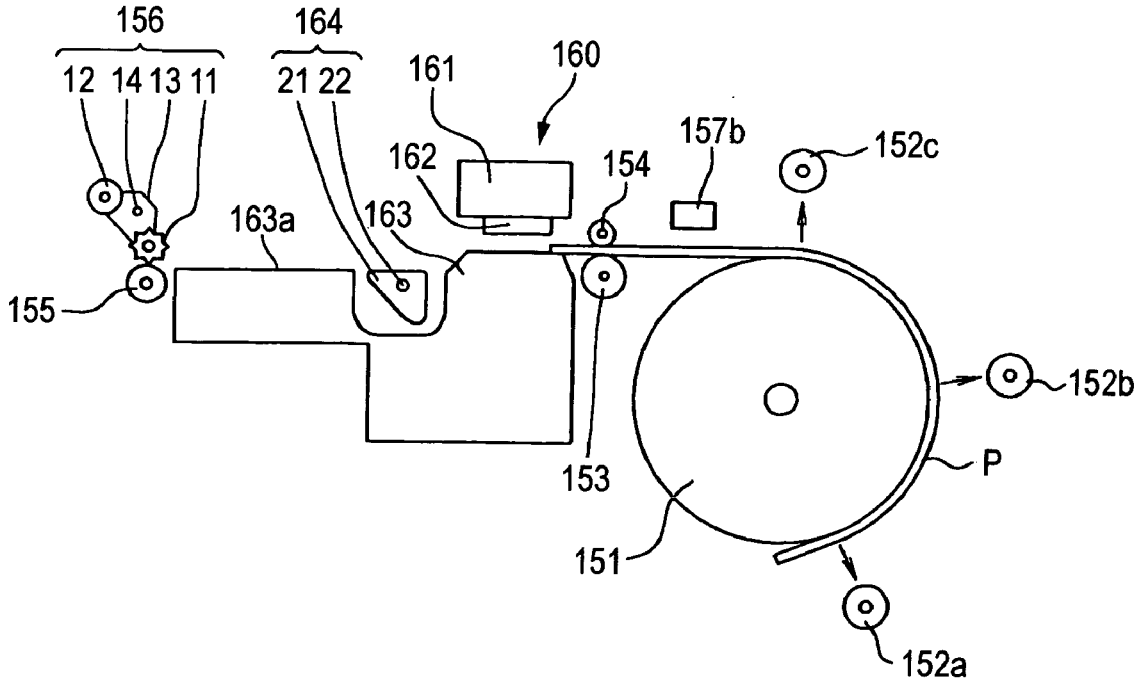

As shown in FIG. 31, the sensor 157*b* is attached to the pivoting member 52 that supports the follower roller 154 that is associated with the sheet feeding roller 155. A hole 163*c* is formed in the platen 163 at a position right under the sensor 157*b*. A vertical wall 163*d*, a wall 163*e* that forms an angle of about 135° with the wall 163*d*, and a wall 163*f* that forms an angle of about 90° with the wall 163*d* are formed inside the hole 163*c*.

The sensor 157*b*, which is generally a photoreflector, may operate erroneously due to incidence of external light (sunlight) or reflection of light generated by itself. However, light generated by the sensor 157*b* itself does not return to the sensor 157*b* because it passes through the hole 163*c*, is reflected by the face of the wall 163*e* to change the path by about 90°, and is again reflected by the face of the wall 163*f* to change the path by about 90° (indicated by a broken line in FIG. 31): an erroneous operation can thus be prevented. External light (sunlight) does not shine on the sensor 157*b* because it is interrupted by the back face of the wall 163*e*: an erroneous operation can thus be prevented.

An operation that is performed when the ink jet printer 100 having the above configuration performs recording on a normal cut sheet will be described with reference to FIGS. 32A and 32B and FIGS. 33A and 33B. First, the control section automatically switches the follower roller unit 156 and the support rib unit 164 for normal cut sheets. More specifically, switching is made to the spur rollers 11 in the follower roller unit 156 and the support ribs 21 of the support rib unit 164 are retracted. The cut sheets P that are stacked and accommodated in the sheet supply tray 210 of the tray unit 200 that is inserted in the sheet supplying/ejecting section 140 are pressed against the sheet supply roller 142 because the hopper 141 is elevated by the restorative force of the compression spring 144 in synchronism with the rotation of the sheet supply roller 142 (the synchronization is achieved mechanically). Only the uppermost cut sheet P is separated by the separation member 143 and supplied to the transporting section 150.

When the thus-supplied cut sheet P reaches a contact point 151*a* of the sub roller 151 and an associated follower roller 152*a* (see FIG. 32A), skew taking of the cut sheet P is performed. The method of skew taking depends on the thickness of a sheet or paper. In the case of a cut sheet that is as thin as or thinner than an ordinary sheet, first, only a quite small tip portion of the cut sheet P is inserted between the sub roller 151 and an associated follower roller 152*a*. The rollers 151 and 152*a* are thereafter rotated in the reverse direction to bend the cut sheet P and thereby align the tip of the cut sheet P. Then, the cut sheet P is taken.

On the other hand, in the case of a thick cut sheet that is thicker than an ordinary sheet, the tip of the cut sheet P is knocked against the contact point 151*a* of the sub roller 151 and an associated follower roller 152*a* and the sheet supply roller 142 is caused to slip, whereby the tip of the cut sheet P is aligned. Then, the cut sheet P is taken. The insertion length or the knock-in length is detected by the sensor 157*a* and the skew taking is controlled on the basis of the detected length.

The reason why the skew taking method depends on the sheet or paper thickness is that a thin cut sheet is brittle and hence the sheet supply roller 142 may send out the cut sheet without slipping on it, and that a thick cut sheet is a lamination of thin cut sheets and hence a thin cut sheet may peel off when the rollers 151 and 152*a* are rotated in the reverse direction.

After completion of the skew taking, the cut sheet P is reversed (i.e., the traveling direction is changed to the direction opposite to the sheet supply direction) as it travels along the U-shaped path while being held between the sub roller 151 which is driven by a sheet fed motor (not shown) and an associated follower rollers 152*a*, 152*b*, and 152*c*. When the tip of the cut sheet P reaches a detection position DP of the sensor 157*b* (see FIG. 32B), paper leading end positioning (i.e., determination of a recording start position) of the cut sheet P is performed.

More specifically, the transport length is detected by the sensor 157*b* until the leading end of the cut sheet P reaches the recording start position HP (see FIG. 33A) after passing the detection position DP and passing between the sheet feeding roller 153 and an associated follower roller 154. The leading end positioning is controlled on the basis of the detected transport length. Conventionally, the leading end positioning is performed by using the sensor 157*a* that is located upstream of the sub roller 151. In contrast, in this embodiment, since the leading end positioning is performed by using the sensor 157*b* that is located downstream of the sub roller 151, a transport length to be detected is short and, in particular, the accuracy of the leading end positioning can be increased by eliminating a paper leading end positioning error due to a difference in sheet or paper thickness.

The cut sheet P that has been subjected to the leading end positioning is transported to the recording section 160 while being held between the sheet feeding roller 153 which is driven by the sheet feed motor (not shown) and an associated follower roller 154. The continuation of the holding of the cut sheet P between the sub roller 151 and an associated follower rollers 152*a*, 152*b*, and 152*c* is a factor of lowering the transport accuracy, and hence the follower rollers 152*a*, 152*b*, and 152*c* are released from the sub roller 151 (see FIG. 33B).

The cut sheet P thus transported is absorbed on the platen 163 by a suction pump (not shown) and is thereby rendered flat, and recording is performed by the recording head 162 mounted on the carriage 161 which is reciprocated for scanning by the carriage motor 166 and the timing belt 165 (not shown). The control section of the ink jet printer 100 performs a high-precision ink dot control, halftone processing, etc. by supplying inks of, for example, a total of seven colors of yellow, light yellow, magenta, light magenta, cyan, light cyan, and black from ink cartridges of the respective colors to the recording head 162 and controlling the discharge timing of the inks of the respective colors and the driving of the carriage 161 and the sheet feeding roller 153. The recorded cut sheet P is ejected onto the sheet supplying/ejecting section 140 by transporting it while holding it between the spur rollers 11 and the sheet ejection roller 155 which is driven by the sheet feed motor (not shown). The cut sheet P is placed (stacked) on the sheet ejection tray 230 of the tray unit 200.

As described above, in the ink jet printer 100 according to this embodiment, the spur rollers 11 and the smooth rollers 12 can be brought into contact with or separated from the recording face of a sheet or paper in accordance with the attribute of the sheet or paper. Therefore, particularly in ejecting a sheet or paper whose recording face is prone to be scratched, the recording face can be prevented from being scratched by separating the spur rollers 11 and the smooth rollers 12, that is, making switching to the release portions 13, whereby the recording accuracy can be kept high. Since the switching shaft 14 is rotated in accordance with the attribute of a sheet or paper, setting can be made to automatic switching by the control section of the ink jet printer 100, which makes it possible to reliably prevent recording unevenness, staining of a sheet or paper, and scratching of the recording face due to a switching error of a user.

The support ribs 21 can be protruded or retracted from the guide face 163*a* in accordance with the attribute of a sheet or paper. Therefore, particularly when the tail of a sheet is released from the sheet feeding roller 153 and the follower roller 154, the sheet can be prevented from rising by supporting its tail portion by protruding the support ribs 21, whereby highly accurate recording can be performed and staining of the sheet can be prevented. Further, since the gear unit 30 for rotating the switching shafts 14 and 22 in link with each other in accordance with the attribute of a sheet or paper, setting can be made to automatic switching by the control section of the ink jet printer 100, which makes it possible to reliably prevent recording unevenness, staining of a sheet or paper, and scratching of the recording face due to a switching error of a user.

The invention can broadly be applied to recording apparatus having a carriage such as a facsimile machine and a copier. The application field of the invention is not limited to recording apparatus. That is, the invention can be applied to liquid ejection apparatus in which liquid droplets suitable for an intended use instead of ink droplets are ejected from a liquid ejection head toward a target medium to have those liquid droplets stuck to the target medium, such as apparatus having a colorant ejection head to be used for manufacture of color filters of a liquid crystal display device or the like, an electrode material (conductive paste) ejection head to be used for formation of electrodes of an organic EL display, a field-emission display (FED), or the like, a bioorganic material ejection head to be used for manufacture of a biochip, a sample ejection head as precision pipettes, or a like liquid ejection head.

What is claimed is:

1. A recording apparatus, comprising:

a recording section, configured to perform a recording operation with respect to a recording medium;

an ejector, configured to eject the recording medium transported from the recording section to the outside of the recording apparatus, the ejector comprising:

a first member operable to press the recording medium in a first state of the ejector and having a first surface on a circumference thereof, the first member including spur rollers and capable of being brought in contact with an ejection roller in the first state;

a second member operable to press the recording medium in a second state of the ejector and having a second surface different from the first surface on a circumference thereof, the second member including smooth rollers and capable of being brought in contact with the ejection roller in the second state; and a third member operable to be opposed to the recording medium without pressing the recording medium in a third state of the ejector, the third member capable of being opposed to the ejection roller without being brought in contact with the ejection roller in the third state; and a first switcher, which selectively causes the ejector to be in one of the first, second and third states in accordance with a property of the recording medium.

2. The recording apparatus as set forth in claim 1, wherein:

the recording section comprises: a guide face which supports the recording medium being transported; and a support member retractably projected from the guide face; and the first switcher selectably causes the support member to be projected or retracted from the guide face.

3. The recording apparatus as set forth in claim 2, wherein the states of the ejector and the states of the support member are interlockingly selected in accordance with the property of the recording medium.

4. The recording apparatus as set forth in claim 1, wherein:

the ejector comprises a revolver in which the first, second and third members are arranged in a circumferential direction thereof; and the first switcher revolves the revolver such that one of the first, second and third members is selectively opposed to the recording medium.

5. The recording apparatus as set forth in claim 1, wherein:

the first, second and third members are arranged in a direction; and an interval between adjacent two of the first, second and third members is identical with each other.

6. The recording apparatus as set forth in claim 1, further comprising:

support ribs, operable to be projected or retracted at a transport path in which the recording medium is transported and which is disposed at an upstream side of the ejection roller; and a second switcher, which selectively causes the support ribs to be projected or retracted in accordance with the property of the recording medium.

7. The recording apparatus as set forth in claim 6, wherein the second switcher is interlocked with the first switcher.

8. A recording method for recording apparatus including an ejector comprising: a first member operable to press a recording medium in a first state of the ejector and having a first surface on a circumference thereof, the first member including spur rollers and capable of being brought in contact with an ejection roller in the first state; a second member operable to press the recording medium in a second state of the ejector and having a second surface different from the first surface on a circumference thereof, the second member including smooth rollers and capable of being brought in contact with the ejection roller in the second state; and a third member operable to be opposed to the recording medium without pressing the recording medium in a third state of the ejector, the third member capable of being opposed to the ejection roller without being brought in contact with the ejection roller in the third state, the recording method comprising:

performing a recording operation with respect to the recording medium;

selectively causing the ejector to be in one of the first, second and third states in accordance with a property of the recording medium; and ejecting the recording medium to the outside of the recording apparatus.

* * * * *